US012331509B2

(12) United States Patent
Langer et al.

(10) Patent No.: US 12,331,509 B2
(45) **Date of Patent: *Jun. 17, 2025**

(54) SYSTEM AND METHODS EMPLOYING PREFABRICATED VOLUMETRIC CONSTRUCTION MODULES INCLUDING TRANSFORMING TRUSS ELEMENTS

(71) Applicant: ROBERT BIRD GROUP PTY LTD, Fortitude Valley (AU)

(72) Inventors: Jason Langer, New York, NY (US); Christian Moore, London (GB)

(73) Assignee: ROBERT BIRD GROUP PTY LTD (AU)

( * ) Notice: Subject to any disclaimer, the term of this patent is extended or adjusted under 35 U.S.C. 154(b) by 0 days.

This patent is subject to a terminal disclaimer.

(21) Appl. No.: 18/733,753

(22) Filed: Jun. 4, 2024

(65) Prior Publication Data

US 2024/0410159 A1 Dec. 12, 2024

Related U.S. Application Data

(60) Division of application No. 18/296,529, filed on Apr. 6, 2023, now Pat. No. 12,031,318, which is a (Continued)

(51) Int. Cl.
*E04B 1/344* (2006.01)
*E04B 1/343* (2006.01)
*E04B 1/348* (2006.01)

(52) U.S. Cl.
CPC ..... *E04B 1/3441* (2013.01); *E04B 1/34384* (2013.01); *E04B 1/34815* (2013.01)

(58) Field of Classification Search
CPC .... E04B 1/344; E04B 1/3441; E04B 1/34384; E04B 1/34815
See application file for complete search history.

(56) References Cited

U.S. PATENT DOCUMENTS 3,336,717 A 8/1967 Ward et al.
3,968,618 A 7/1976 Johnson
(Continued)

FOREIGN PATENT DOCUMENTS

DE 102018101157 A1 7/2019
EP 2535470 A1 12/2012
(Continued)

*Primary Examiner* — Christine T Cajilig
(74) *Attorney, Agent, or Firm* — Perkins Coie LLP; Colin Fowler; Adwait Jawale

(57) ABSTRACT

Disclosed herein is the fabrication and implementation of prefabricated volumetric construction modules that include transitioning members that adjust between vertical support columns and structural trusses via lateral joints. Modification of vertical support columns to trusses enables open space configurations in volumetric construction. Each volumetric module includes a habitation zone and a truss zone. Folding or transitioning a vertical support column at the lateral joint positions a lower region of the support column from the habitation zone into the truss zone. The vertical support columns are transitioned in a specified order where within a given row of vertical support columns. Beginning from a first interior column on an edge-positioned transforming volumetric module, workers fold half of the vertical support columns of the given row into the truss arrangement in a first direction toward the edge-positioned transforming volumetric module. Continuing from a second interior column on an opposite edge-positioned transforming volumetric module, a worker folds a remaining half of the vertical support columns of the given row into the truss arrangement in a second direction toward the opposite edge-positioned transforming volumetric module.

12 Claims, 28 Drawing Sheets

906: Install
Centre Module lifted off back of truck.

908: First Transformation
Middle support column members rotated into vertical position. TLF's connected to middle support column members. Assembly is confirmed to be within level tolerances, and is then released from the lifting gear.

☆ denotes connection types made or adjusted in this step

Related U.S. Application Data continuation of application No. 18/164,408, filed on Feb. 3, 2023, now Pat. No. 11,802,402.

(56) References Cited

U.S. PATENT DOCUMENTS

| | | | |
|---|---|---|---|
| 4,045,926 | A | 9/1977 | Gibbs |
| 4,242,845 | A | 1/1981 | Osborne |
| 5,461,832 | A | 10/1995 | Smith |
| 2014/0123572 | A1 | 5/2014 | Segall |
| 2015/0121776 | A1 | 5/2015 | Peterson et al. |
| 2017/0370091 | A1 | 12/2017 | Dragan |
| 2023/0095414 | A1 | 3/2023 | Lippert |

FOREIGN PATENT DOCUMENTS

| | | | |
|---|---|---|---|
| FR | 920723 | A | 4/1947 |
| GB | 2029474 | A | 3/1980 |

TRANSPORT MODE

904: Transport
Stack modules on the back of a truck for transport.
Centre Module must always be on top as it is erected first on site during Installation Mode.

902: Transportation Mode
Fabricate modules in fabrication warehouse and test-fit modules on the factory floor.

906: Install
Centre Module lifted off back of truck.

908: First Transformation
Middle support column members rotated into vertical position. TLF's connected to middle support column members. Assembly is confirmed to be within level tolerances, and is then released from the lifting gear.

☆ denotes connection types made or adjusted in this step

910: Install
End Module lifted off back of truck

912: First Transformation
End support columns rotated into vertical position. End module dropped into position. End support column base connections made. End module released from lifting gear. End module connected to middle module.

☆ denotes connection types made or adjusted in this step

STEP 910: Install
End Module lifted off back of truck

STEP 912: Installation Mode Complete
End support columns rotated into vertical position. End module dropped into position. End support column base connections made. End module released from lifting gear. End module connected to middle module.

☆ denotes connection types made or adjusted in this step

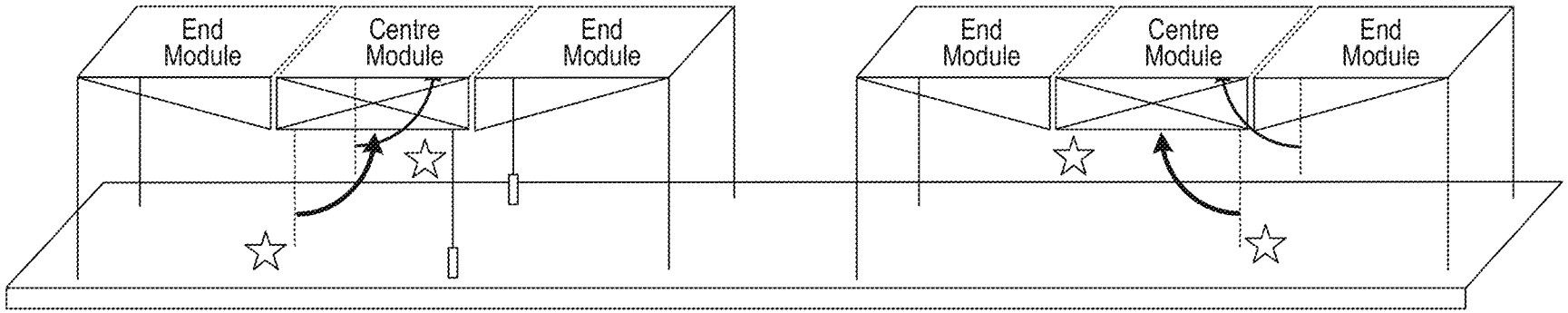

914: Second Transformation
Disconnect first middle support column from TLF. Rotate into final truss position.
Bolt final middle support column connection.

916: Building Mode Complete
Disconnect second middle support column from TLF.
Rotate into final truss position.
Bolt final middle support column connection.

☆ denotes connection types made or adjusted in this step

*FIG. 9F*

922: Repeat Process
Additional levels are added by repeating the same process from Steps 902-920 until the building is complete.

☆ *NOTE: the system is designed such that the temporary loads from the TLF's on the upper level can be supported adequately by the transformed modules structure on the lower level.*

SYSTEM AND METHODS EMPLOYING PREFABRICATED VOLUMETRIC CONSTRUCTION MODULES INCLUDING TRANSFORMING TRUSS ELEMENTS

CROSS-REFERENCE TO RELATED APPLICATION(S)

This application is a divisional of U.S. patent application Ser. No. 18/296,529, titled SYSTEM AND METHODS EMPLOYING PREFABRICATED VOLUMETRIC CONSTRUCTION MODULES INCLUDING TRANSFORMING TRUSS ELEMENTS and filed Apr. 6, 2023, which is a continuation of U.S. patent application Ser. No. 18/164,408, titled SYSTEM AND METHODS EMPLOYING PREFABRICATED VOLUMETRIC CONSTRUCTION MODULES INCLUDING TRANSFORMING TRUSS ELEMENTS and filed Feb. 3, 2023, now U.S. Pat. No. 11,802,402, granted Oct. 31, 2023, the aforementioned applications are incorporated herein by reference in their entirety.

TECHNICAL FIELD

The disclosure relates to building construction and, more particularly, to prefabricated volumetric construction modules.

BACKGROUND

Volumetric modular construction is a technique where factory-finished modules are stacked and joined to form a substantially complete building. Volumetric construction includes the advantage of limited on-site labor, typically only including bolting and interconnection of building services. The building components are manufactured in an off-site factory and delivered in trucks to a building site. A notable downside of volumetric construction is that building designs are limited by the requirement that the various modules must fit on trucks. Consequently, the size of any given open space is limited to the size of a module.

BRIEF DESCRIPTION OF THE DRAWINGS

FIGS. 9A-H are step-by-step illustrations of a transition method of a second a varied transforming volumetric module.

DETAILED DESCRIPTION

Figure 1A:
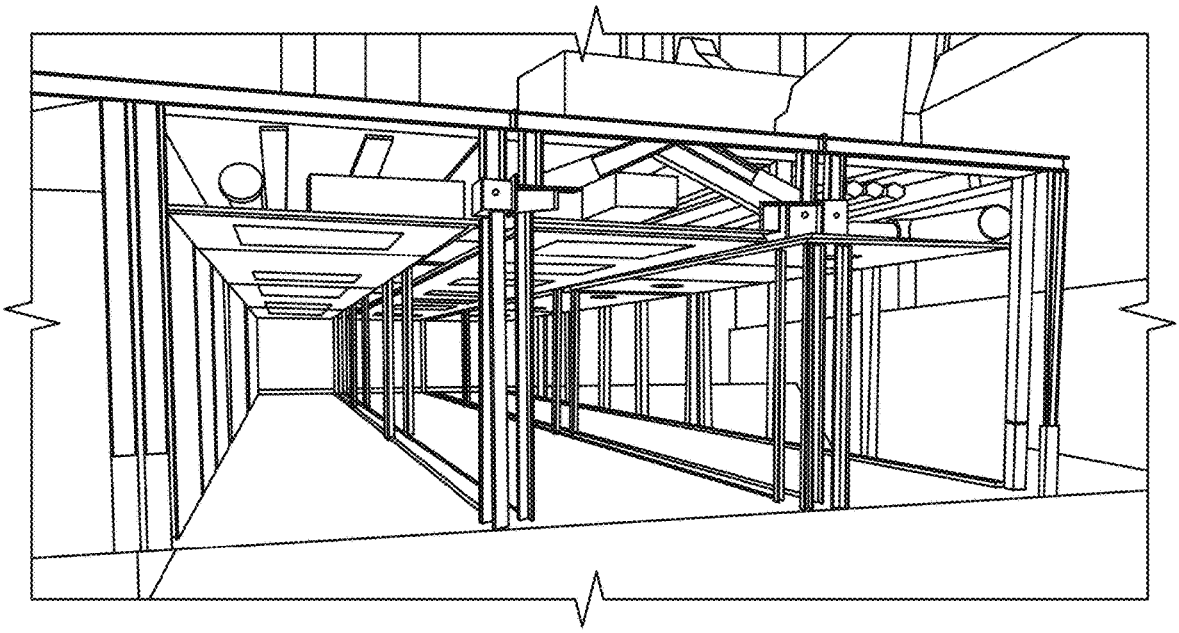
FIG. 1A is an illustration of a set of transforming volumetric modules in an installation configuration.

Transforming volumetric construction modules make use of adjustable trusses that shift from a vertical configuration to a truss configuration that enables the construction of volumetric buildings with large open spaces within the design (e.g. less internal support columns/pillars, and potentially none). Disclosed herein is a prefabricated construction volumetric module comprising:

A frame structure divided into a truss zone and a habitation zone below the truss zone. The habitation zone is where inhabitants reside during use of the building. The truss zone is where structural trusses support the overall structure of the building.

The frame structure includes a base, a top, and support columns. The support columns include lateral joints that enable the support columns to fold or transition from a vertical column to a structural truss. The lateral joint is the boundary between the truss zone and the habitation zone. Folding or transitioning a column at the lateral joint positions a lower region of the support column from the habitation zone into the truss zone. A column receiver positioned within the truss zone affixes the column when folded as a structural ceiling truss.

The transformation of the volumetric construction modules is performed in a particular order. After the volumetric components are positioned and connected to one another, a team of workers transform temporary vertical supports into trusses in the truss zone. The workers begin by transitioning an outermost temporary support by folding the temporary support outwards to lock as a truss on the exterior edge of the volumetric module. The process is then repeated for each truss that folds in the same direction. The process is then repeated for trusses that fold in the opposite direction.

Stated another way: (a) the support in the leftmost module is folded to the left as a truss; (b) the support in the next module (going right) is also folded left until the workers transform the second to last module (e.g., second from the right); (c) the support in the rightmost module is folded to the right as a truss; and (d) the support in the next module (going left) is also folded right until the workers transform the second to last module (e.g., second from the left). In a three-module structure, the trusses are transformed in a "left, left, right, right" cadence.

The transforming trusses enable new methods of construction using prefabricated volumetric modules that generate open space without interrupting vertical columns. First, a designer identifies which prefabricated modules are necessary for a given building design. Modules that are positioned in the center of an open space differ from modules on the building exterior. Exterior modules include folding support columns, but the folding is solely for the purpose of ease of transport rather than transforming into a truss.

A designed building may include an open space in a desired configuration, exist around a permanent core (e.g., constructed of concrete), include atriums (e.g., multi-level open space), or make use of non-rectangular or even curved elements. In each design, a set of prefabricated volumetric building blocks is selected for purposes of building construction. Because each volumetric module differs based on purpose or location in the building, the building blocks are assigned particular locations in the building (e.g., like children's building bricks).

Even where the volumetric modules are of a similar physical size, the transforming truss/bracing configuration varies based on location within the building. Thus, unlike the children's building bricks, the volumetric modules vary based on structural integrity provided as opposed to merely physical shape.

Once the set of volumetric modules is determined, those modules are fabricated. The fabricated modules are configured into a travel mode where each of the vertical supports is folded so as to reduce the overall height of each module. The reduction in height of the modules enables multiple modules to be stacked on top of one another in a truck bed for travel. The modules are then transported to a construction site. Once at the construction site, the supports of the modules are again extended to be vertical. The modules are then arranged into a floorplan configuration with vertical support columns in a vertical arrangement. Finally, the temporary supports are transitioned into a truss arrangement via a telescoping action that reduces individual column length and transitioning in a specified order where within a given row of vertical support columns.

Beginning from a first interior column on an edge-positioned transforming volumetric module, workers fold half of the vertical support columns of the given row into the truss arrangement in a first direction toward the edge-positioned transforming volumetric module. Continuing from a second interior column on an opposite edge-positioned transforming volumetric module, a worker folds a remaining half of the vertical support columns of the given row into the truss arrangement in a second direction toward the opposite edge-positioned transforming volumetric module. Finally, workers install mechanical, electrical, and plumbing ("MEP") elements in the truss zone, or simply connect these elements across modules in the truss zone, in the case where the MEP elements have been pre-attached to the modules, in the fabrication yard.

Figure 1B:
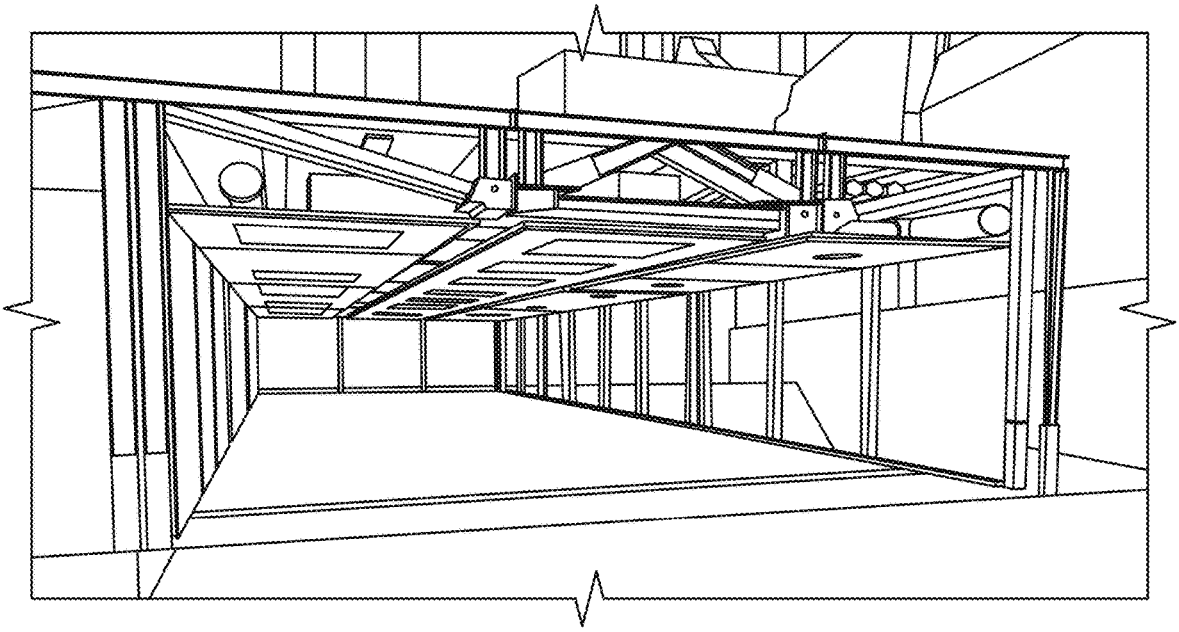
FIG. 1B is an illustration of a set of transforming volumetric modules in a permanent support truss configuration.

FIGS. 1A and 1B are illustrations of a set of transforming volumetric modules in an installation configuration 102 and a permanent support truss configuration 104, respectively. In the installation configuration 102, the transforming volumetric modules appear similar to traditional, well-known volumetric modules. Workers place the modules (e.g., with a crane) and then bolt the modules to one another. The installation configuration involves many vertical columns that crowd habitation space and prevent many desirable use configurations. Internal junctions where modules meet and are bolted together have two to four vertical columns.

However, the columns fold upward into the ceiling and transform into structural trusses. Specifically, the columns fold into a structure that approximates a bowstring truss. Where the columns are folded into the ceiling, the habitation space is clear for any use configuration that inhabitants desire.

In both configurations 102 and 104, two different styles of transforming volumetric modules are depicted: a truss end module 106 and a truss middle module 108. The truss end modules 106 make use of a single transforming support to transition into a diagonal truss and bolt to a column receiver in a truss zone of the module. One column persists as a permanent, vertical column. In a truss middle module 108, two transforming supports fold horizontally into a single horizontal truss and make use of no permanent vertical columns.

The building configuration depicted in FIGS. 1A and 1B makes use of a three-module pattern that uses two truss end modules 106 and one truss middle module 108. The chosen configuration depicted is one embodiment of many potential embodiments. Different combinations/patterns of truss end modules 106 and truss middle modules 108 are implemented in other embodiments.

Method of Transition of Transforming Volumetric Modules

Figure 2A:
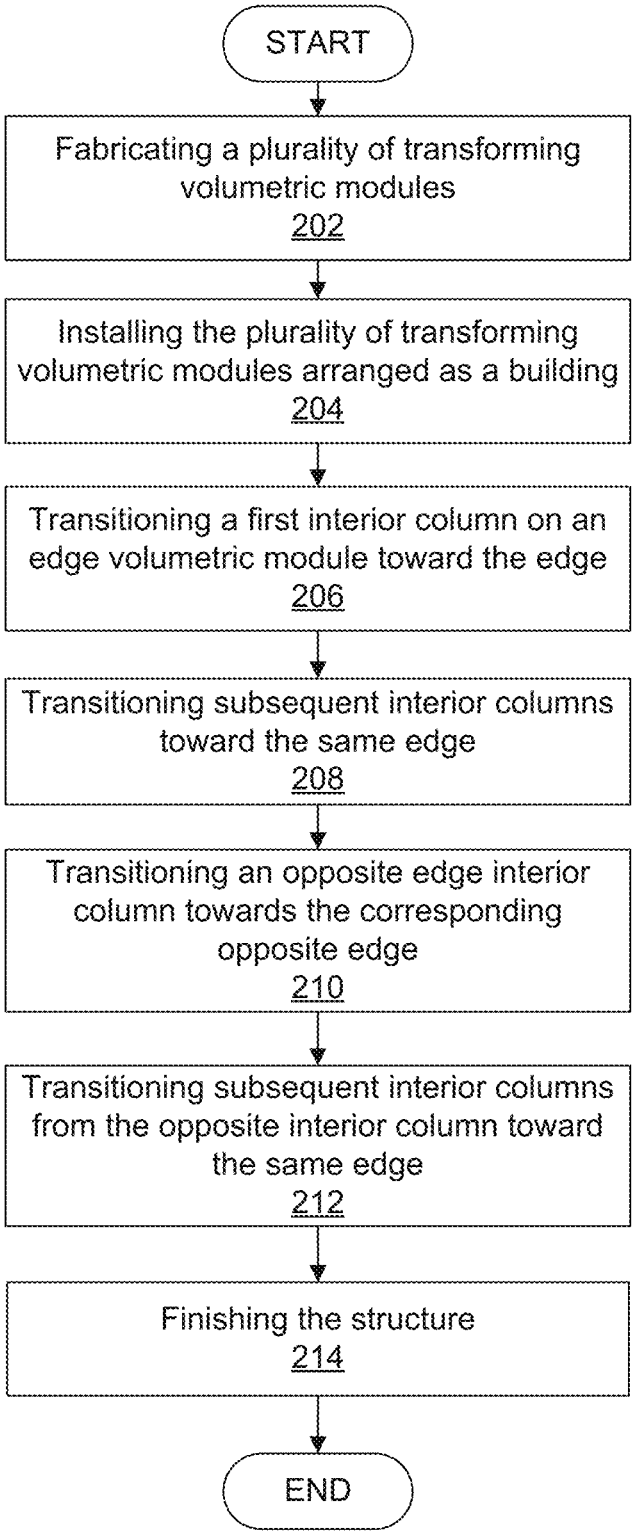
FIG. 2A is a flowchart illustrating a transition method of the transforming volumetric module.
Figure 2C:
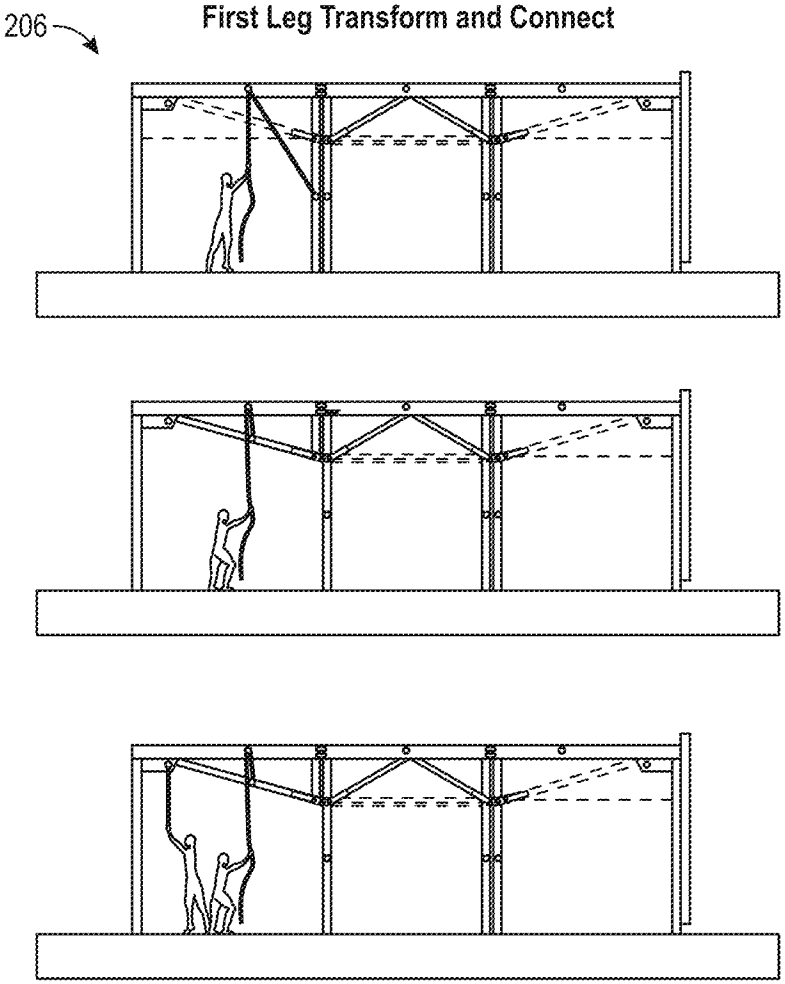
FIGS. 2B-2F are step-by-step illustrations of the transition method of the transforming volumetric module.

FIG. 2A is a flowchart illustrating a transition method of the transforming volumetric module. FIGS. 2B-2F are companion illustrations of the flowchart of FIG. 2A.

In step 202, transforming volumetric modules that correspond to a given building are fabricated according to building plans. In step 204, workers position and install the transforming volumetric modules adjacent to one another in a floorplan configuration. Each transforming volumetric module includes a habitation zone and a truss zone positioned above the habitation zone. The transforming volumetric modules include vertical support columns positioned on external edges that are configured to fold at a column joint and become trusses in the truss zone. The column joint is positioned where the habitation zone meets the truss zone.

When installed, the vertical support columns are in a temporary vertical arrangement. Installation includes fastening a number of bolts between the modules. The bolts enable adjacent modules to support one another. When compared to traditional construction labor, installing the volumetric modules is significantly easier and includes fewer steps. A small team (e.g., 2 workers) can easily perform the task with a winch and hand tools.

In step 206, the workers begin transitioning the vertical support columns from the vertical arrangement to a truss arrangement in a specified order where within a given row of vertical support columns. The transition begins from a first interior column on an edge-positioned transforming volumetric module. The workers fold the interior column on an edge module up into the truss zone and secure the column there.

Figure 2B:
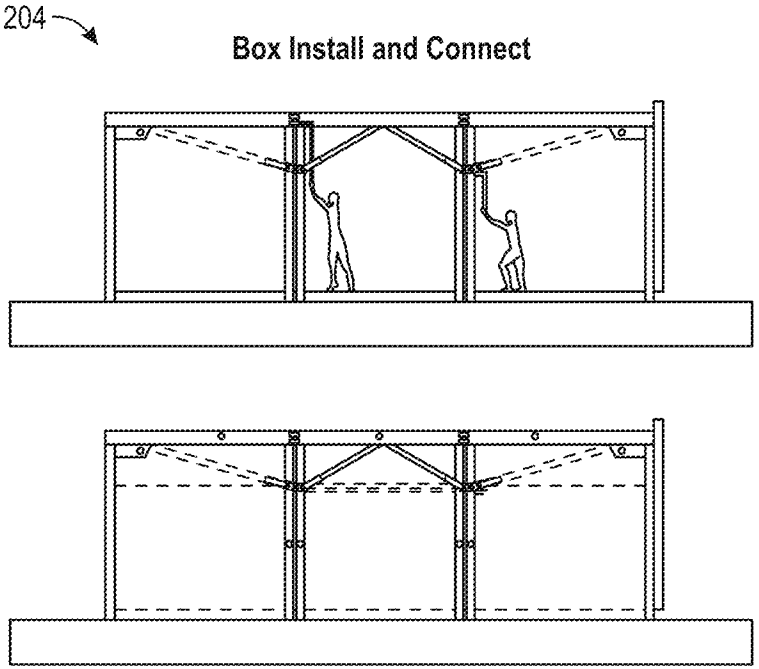

As depicted in FIG. 2B, the first column to the far left is a permanent column and remains vertical. The second column from the left ("the first interior column on an edge-positioned transforming volumetric module") is folded toward the edge (left) into the truss zone and secured as a truss. Depending on volumetric module configuration, the column may need to be adjusted in length in order to meet the size requirements of the truss configuration (as is the case for all subsequent column transitions). The column includes telescoping components in order to perform the length change. While the figures depict the choice of the leftmost transforming column, embodiments of the disclosed method may similarly begin from the rightmost transforming column.

In some embodiments, affixing the column is performed using bolts. A small team may employ a pulley device to lift the column into place. A first worker moves the column into the truss configuration with the pulley device, and a second worker fastens the column into the truss configuration with bolts. Depending on the pattern of the volumetric module, the "edge" volumetric module may refer to the module on the edge of the building, an internal "edge" (e.g., a module abutting a permanent building core), or a module on an edge of a repeating pattern of volumetric modules.

In step 208, workers transition subsequent volumetric module columns so that half of the vertical support columns of the given row are positioned into the truss arrangement in a first direction, similar to step 206. Depicted in FIG. 2D, workers transition a column from a middle truss module horizontally and to the left (matching the direction of the first transitioned truss). Step 208 repeats for each temporary column that is to be oriented in the same direction as the first (half of the columns). In module configurations that make use of multiple middle truss modules, additional columns are transitioned the same direction (left) in order down the row.

Figure 2E:
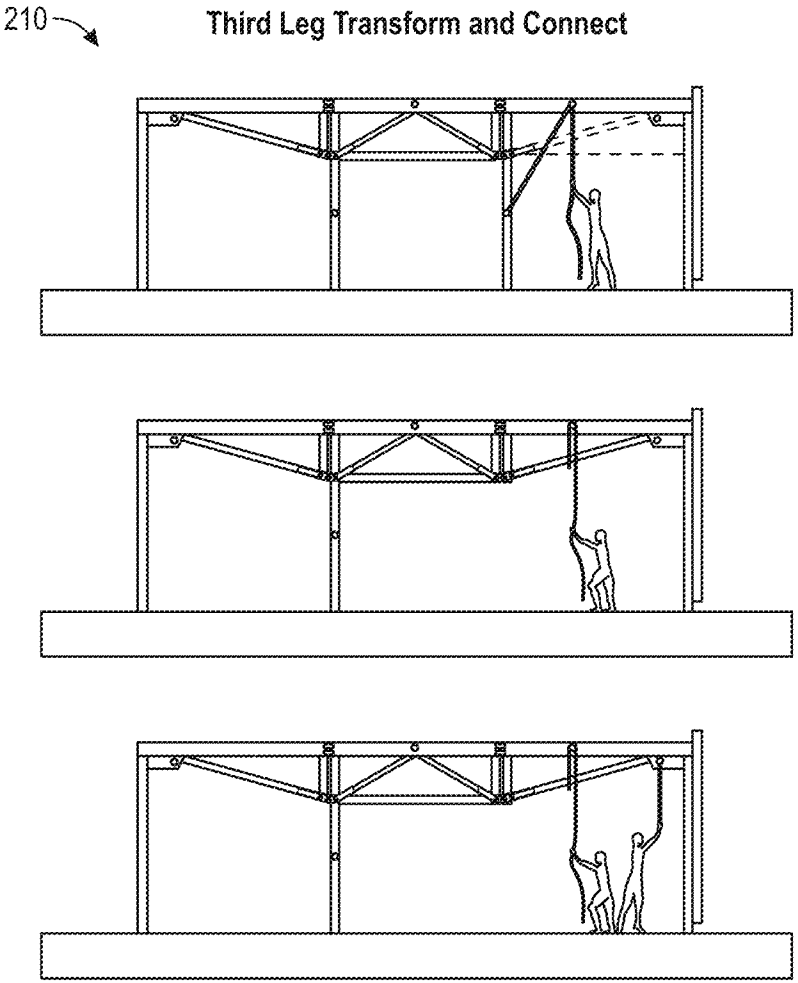
Figure 2D:
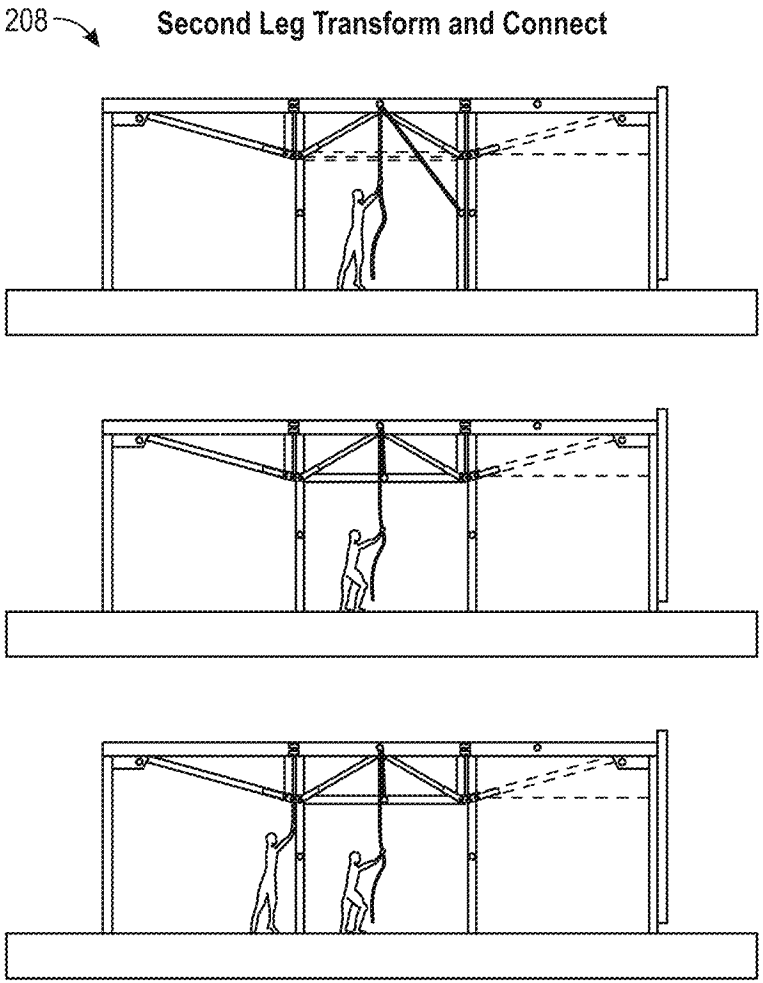
Figure 2F:
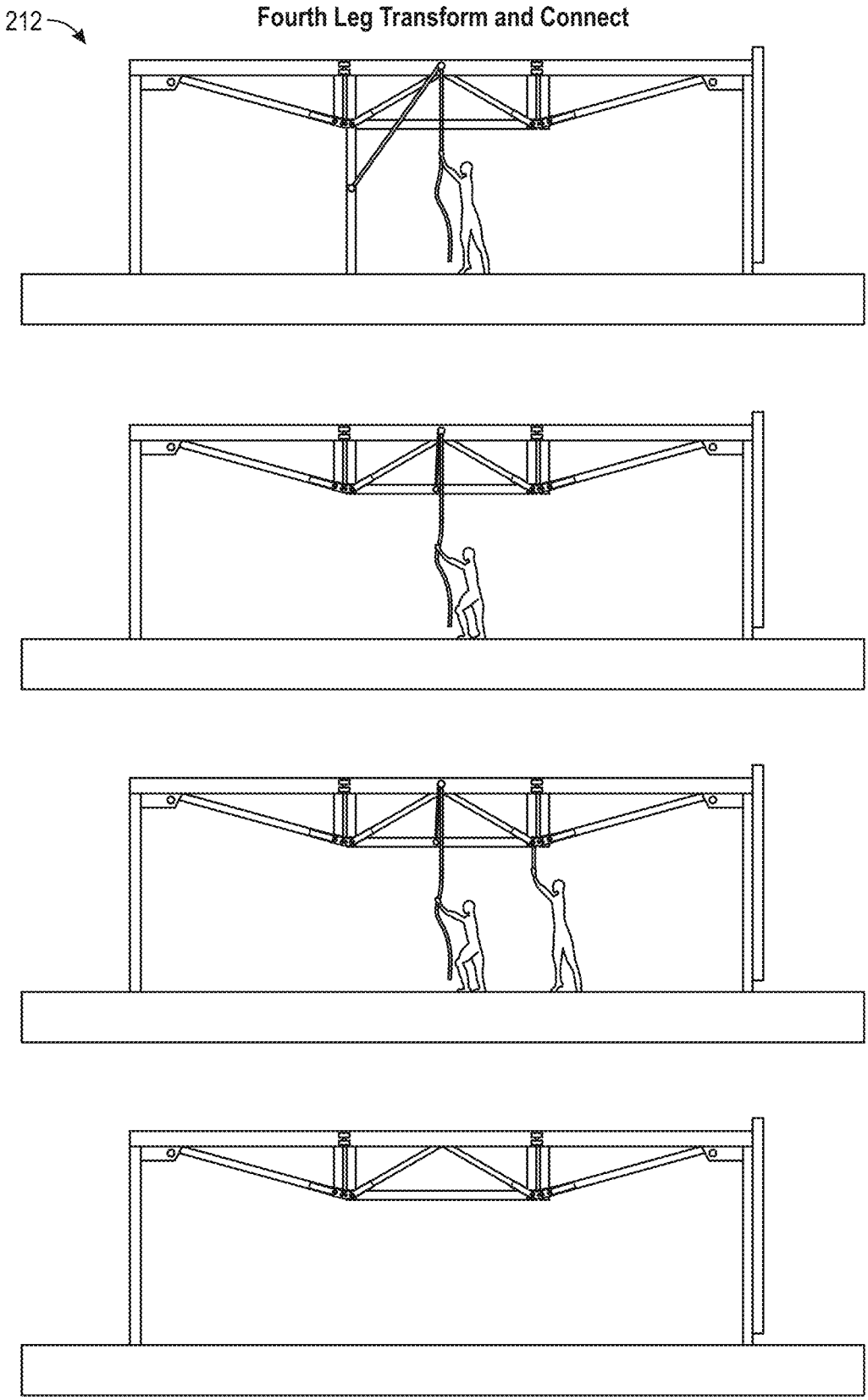

In step 210, continuing from a second interior column on an opposite edge-positioned transforming volumetric module, workers fold a corresponding edge column in the opposite direction (e.g., to the right). FIG. 2E depicts a rightmost interior column as transitioning. Step 210 is similar to step 206 but performed as a mirror image. The second column from the right is folded toward the edge (right) into the truss zone and secured as a truss.

In step 212, workers transition the remaining half of the vertical support columns of the given row into the truss arrangement in the second direction (e.g., right) toward the opposite edge-positioned transforming volumetric module. In this step the columns double back over existing secured trusses affixed in step 208. In some embodiments, the columns make use of an L-shaped girder or beam in order to position two columns in a similar space. In some embodiments, the double-backed columns are bolted to the previously affixed columns.

In step 214, workers finish the modules by installing MEP elements in the truss zone (or connecting the MEP elements across modules, in the case where the MEP elements have been pre-attached to the modules, in the fabrication yard) and partition off the truss zone from the habitation zone with ceiling tiles.

Figure 2G:
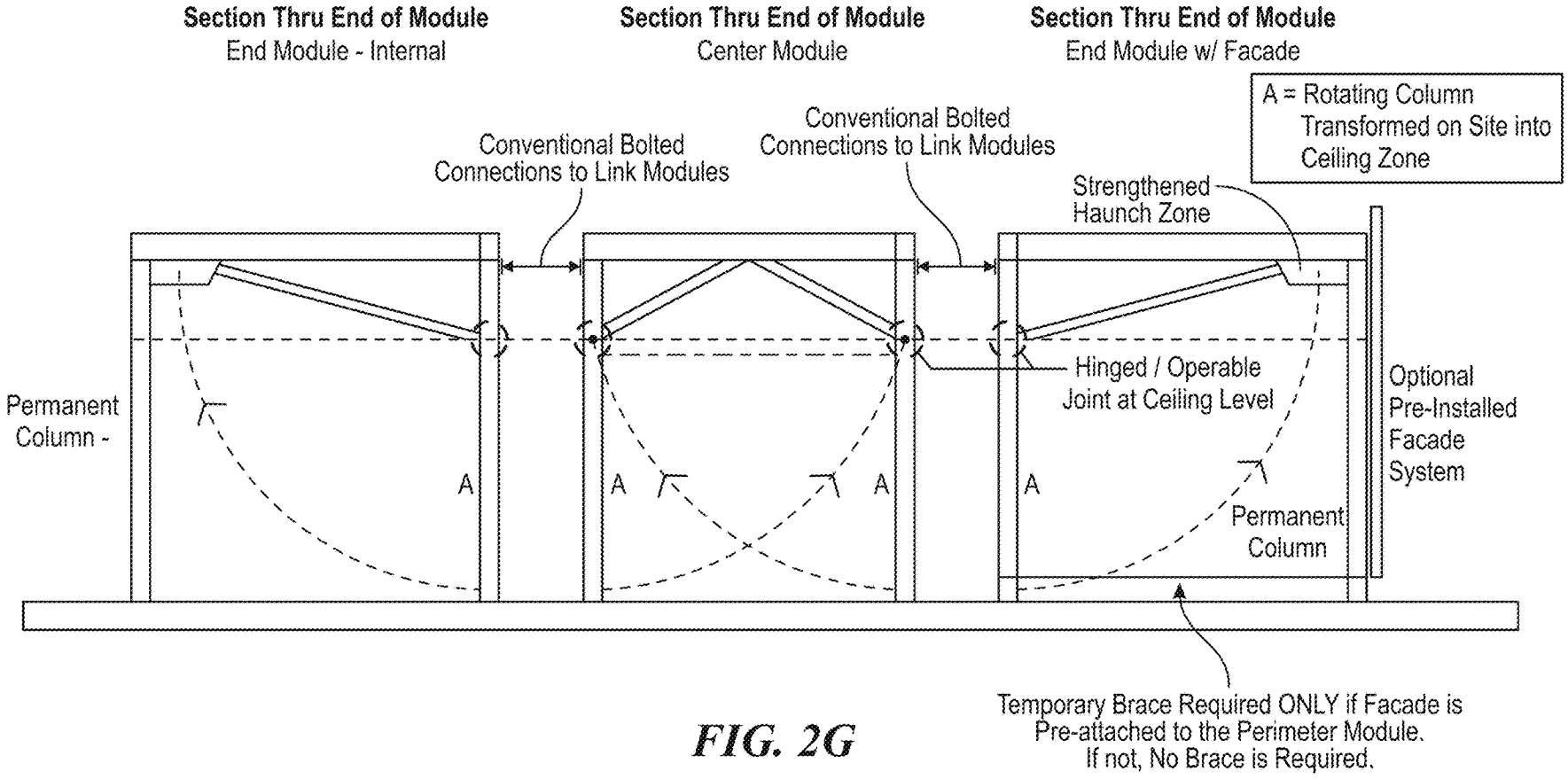
FIG. 2G is a single illustration of the transition method of the transforming volumetric module.
Figure 2H:
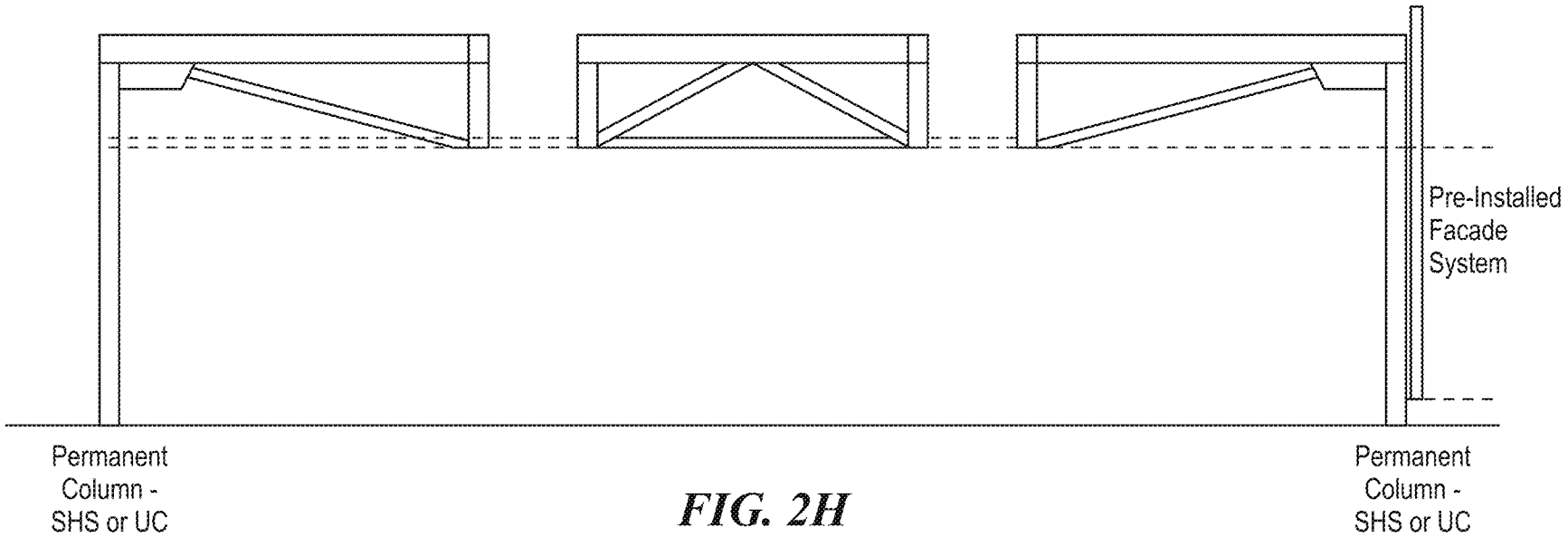
FIG. 2H is an illustration of a completed transition of the transforming volumetric module.

FIG. 2G is a single illustration of the transition method of the transforming volumetric module. The transitions of FIGS. 2B-2F are depicted in a set of dotted line transitions. FIG. 2H is an illustration of a completed transition of the transforming volumetric module. In each exemplary figure, a pattern of three modules is depicted. The depicted pattern includes two edge truss modules and a single middle truss module. Other configurations of modules exist in other embodiments. For example, two edge modules surrounding two or more middle truss modules is an acceptable embodiment. Similarly, in some embodiments, the three-module pattern depicted in FIGS. 2B-2H is implemented as a repeating pattern in a building configuration using a set of modules that is divisible by three.

Design and Transportation of Transforming Volumetric Modules

Figure 3:
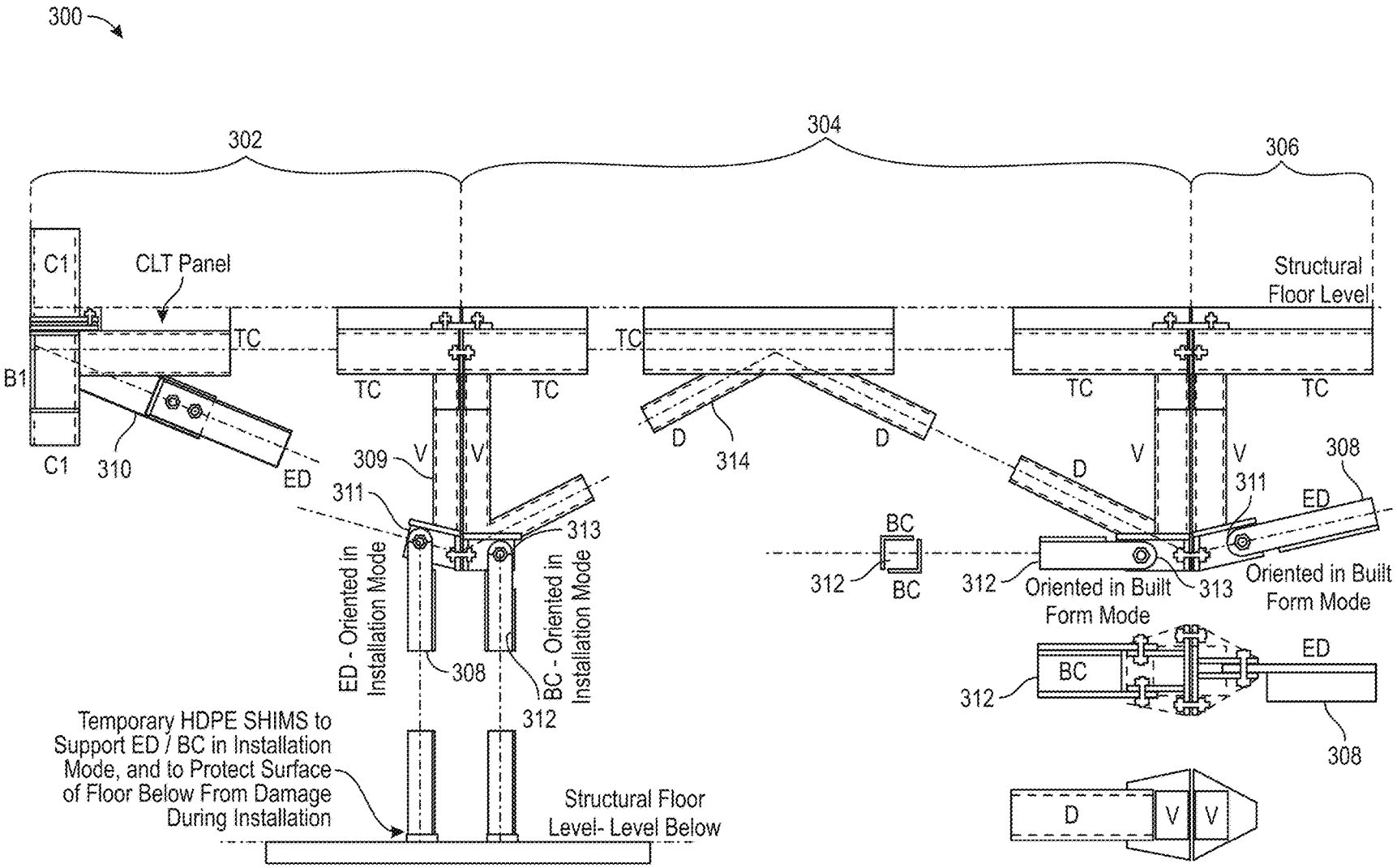
FIG. 3 is a schematic view of column-to-truss transforming elements of the transforming volumetric module.

FIG. 3 is a schematic view of column-to-truss transforming elements 300 of the transforming volumetric module. The schematic view depicts three modules 302, 304, and 306 in various states and configurations. The three modules 302, 304, and 306 are bolted together. The modules 302, 304, and 306 include a number of beams 308, 309, 310, 312, and 314.

Modules 302 and 306 are end truss modules. End truss modules include temporary vertical supports that fold into diagonal trusses comprising beams 308 and 309. Beam 309 is a permanent beam that provides support in the truss zone. Beam 308 is a temporary column that folds into a diagonal truss. When configured as a truss, beam 308 affixes to receiver beam 310. Beams 308 and 309 are joined at diagonal joint 311. The diagonal joint 311 enables lateral folding of beam 308 at a diagonal angle. Beams 308 and 309 are configured to prioritize structural integrity while in truss configuration as that is the intended long-term configuration. The vertical configuration is used for installation and some transport periods.

In some embodiments the overall building is constructed in completed floors—that is, prior to adding modules for subsequent floors, the modules in a current floor are each transitioned first. By completing a given floor before positioning subsequent floors, the forces applied to beams 308 and 309 (which are depicted as being positioned offset) are not excessive. In some embodiments, beams 308 and 309 are in line with one another and forces applied thereto are not offset.

In module 304, a middle truss module, beams 312 and 309 make up temporary vertical supports that fold into horizontal trusses. Two beams 312, from either side of the module 304 fold laterally at corresponding joints 313. The beams 312 are configured to together form a single, horizontal beam. Middle truss modules, such as module 304, further include permanent truss beams 314. Beams 312 and 309 are configured to prioritize structural integrity while in truss configuration as that is the intended long-term configuration. The vertical configuration is used for installation and some transport periods.

Figure 4:
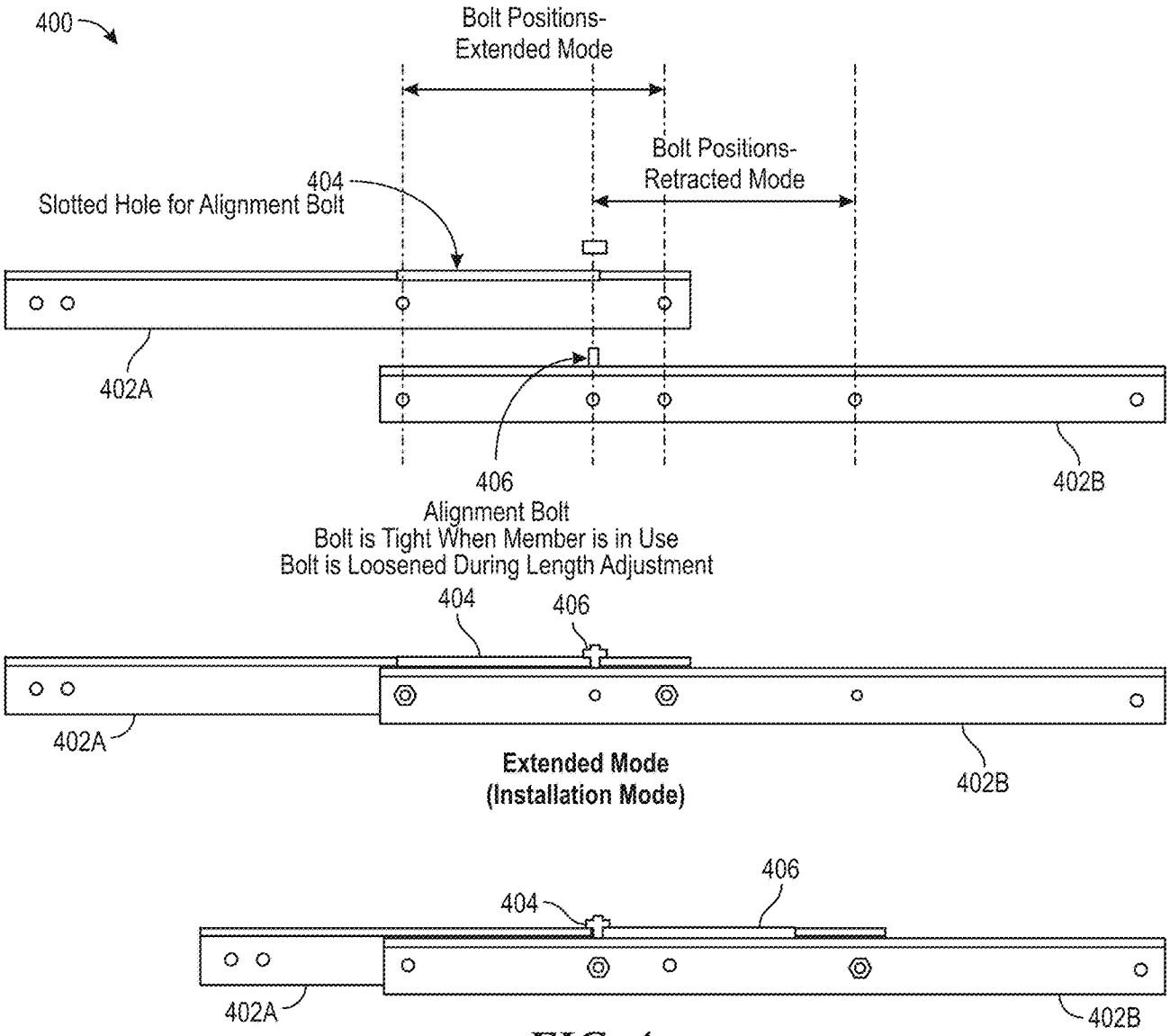
FIG. 4 is a schematic diagram of telescoping supports.

FIG. 4 is a schematic diagram of telescoping supports 400. Depending on the size of the volumetric modules, the beams 402 (such as those discussed in reference to FIG. 3) adjust in size in order to meet the size requirements of each configuration (e.g., vertical support and truss). In order to adjust size, the beams 402 include a telescoping feature. In some embodiments, the truss configuration makes use of shorter beams than the installation (e.g., vertical column) configuration. The telescoping feature makes use of a slot 404 in a first beam 402A and an alignment bolt 406 on a second beam 402B. The alignment bolt 406 slides within the slot 404 and guides the first and second beams 402A/B through the telescoping feature. The first and second beams 402A/B include pre-bored holes where bolts secure the overall beam 402 to a desired length.

Figure 5:
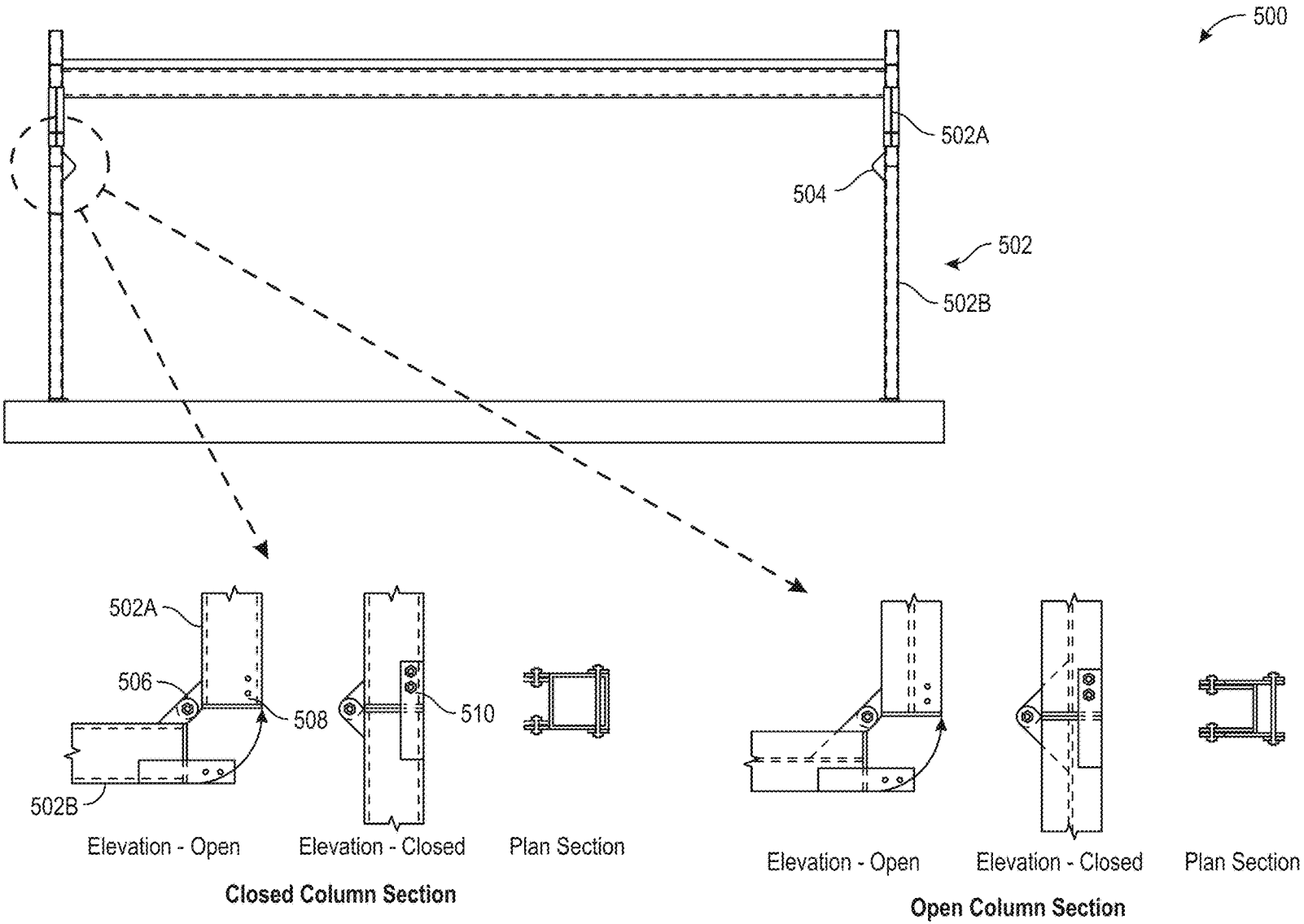
FIG. 5 is a schematic diagram of permanent external support columns.

FIG. 5 is a schematic diagram of permanent external support columns 500. Discussion thus-far has focused on transforming columns of the volumetric modules. The exterior columns 502 on the edge truss modules are configured to support the building permanently, in a vertical configuration. Nevertheless, in some embodiments, the exterior columns 502 are configured to fold laterally in order to reduce the overall height of the volumetric modules for transit. Known volumetric modules are of a static size and shape and are generally transported one-per-truck. Volumetric modules that reduce in size are able to pack a greater number of modules per transport truck.

Thus, exterior columns 502 include an upper portion 502A and a lower portion 502B. The lower portion 502B folds laterally to a horizontal position in a lengthwise direction at joint 504. Joint 504 includes an offset hinge 506 and a flat joining surface 508 that enables a direct transfer of force between the upper portion 502A and the lower portion 502B. The direct transfer of force prevents the weight of the building from resting on bolts in a hinge.

When in the vertical configuration, the exterior column 502 further includes a flange 510 that bolts the two portions 502A/B together to prevent lateral shifting.

Building materials for the volumetric modules vary based on building needs and aesthetic concerns of building users. Example construction materials include any of: steel, concrete, timber, or mass timber composite.

Figure 6A:
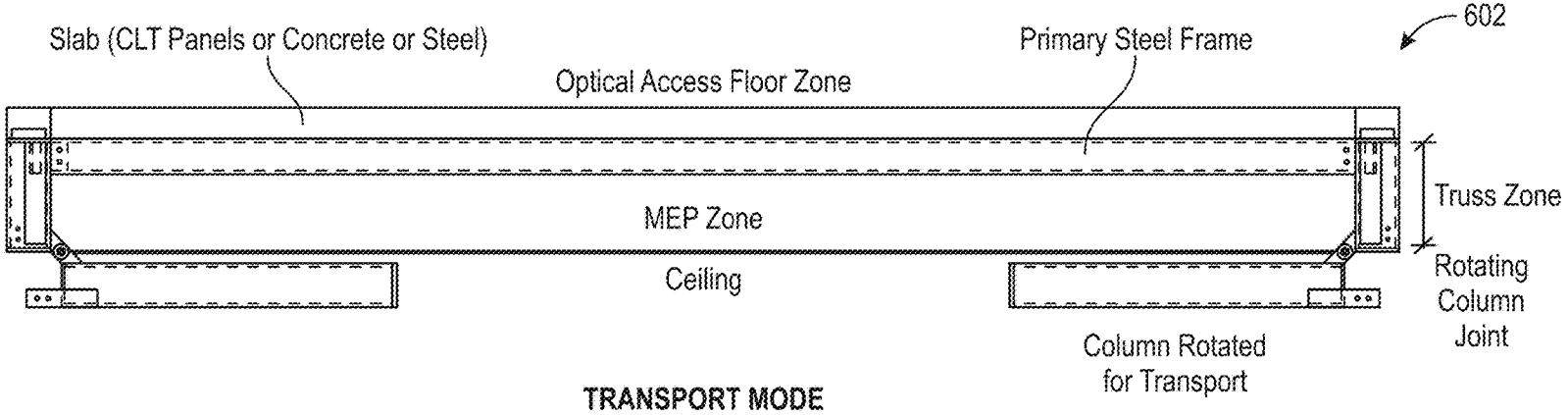
FIGS. 6A-C are illustrations of transport configurations of the transforming volumetric modules.
Figure 6B:
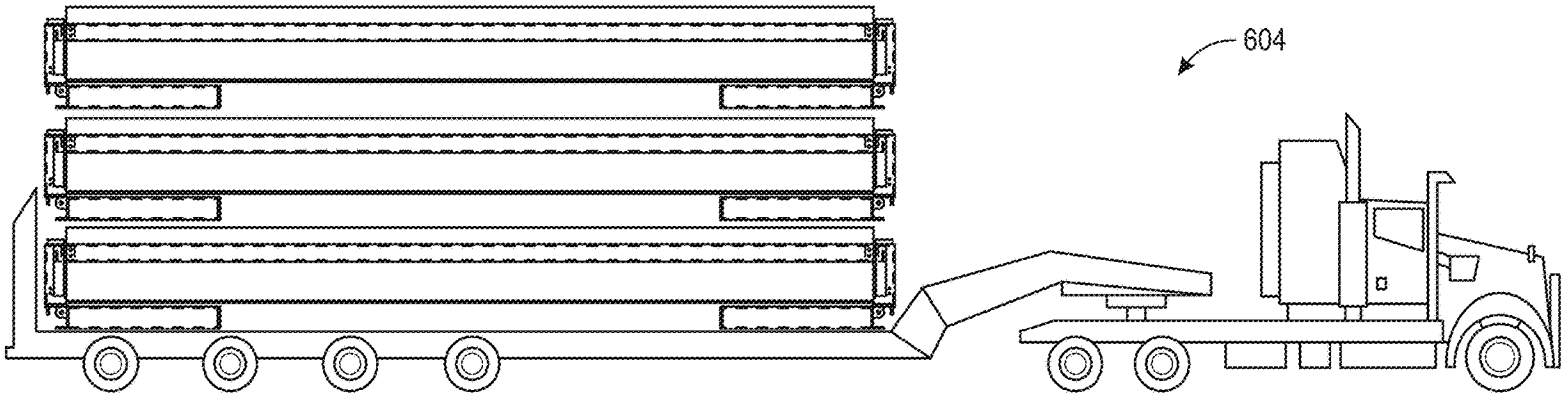
Figure 6C:
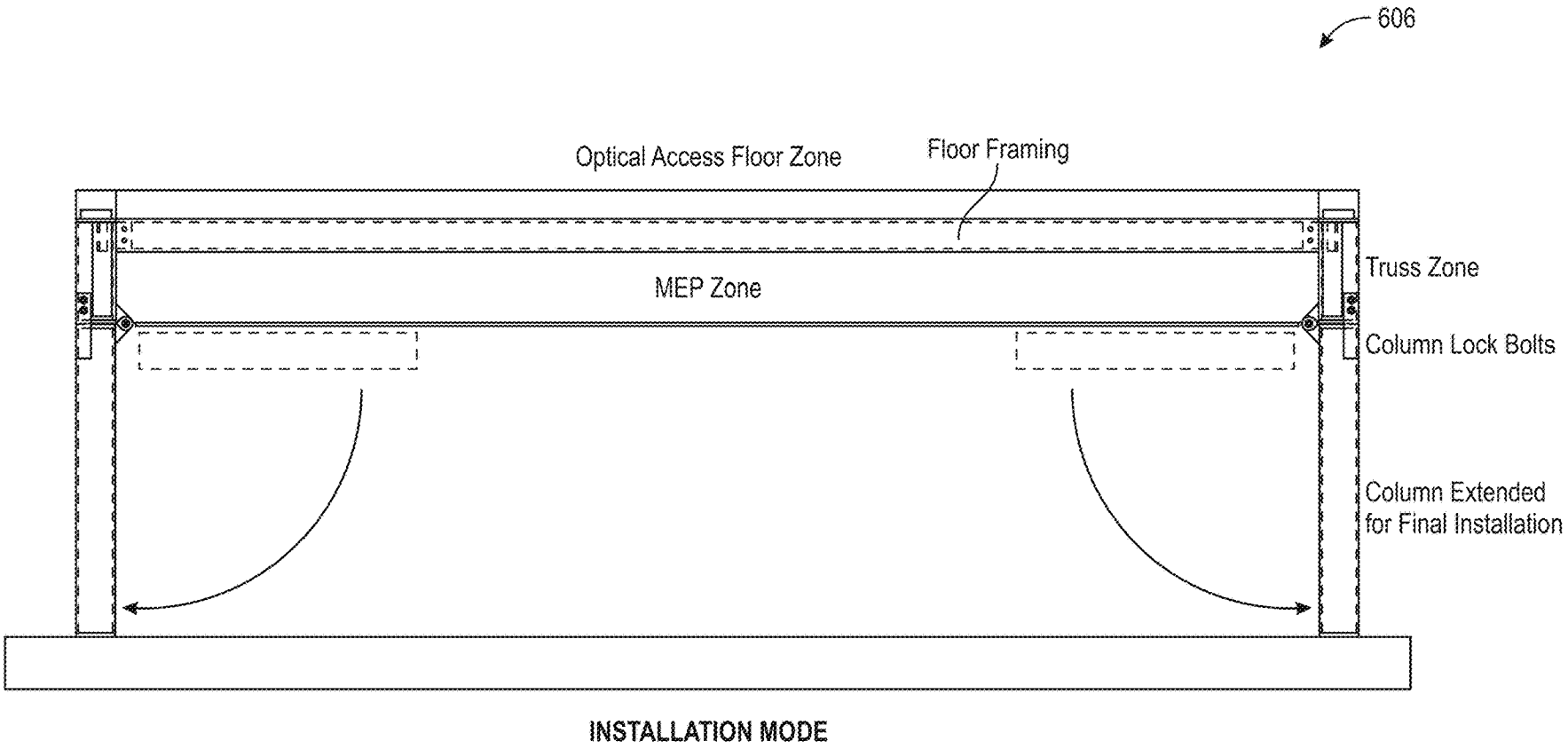

FIG. 6A-C are illustrations of transport configurations of the transforming volumetric modules. Diagram 602 illustrates a top portion of a volumetric module where vertical support columns have been folded, thereby reducing the overall height of the volumetric module. Diagram 604 illustrates the positioning of multiple volumetric modules transitioned into a travel configuration stacked atop one another and on the bed of a truck for efficient transport.

Figure 7:
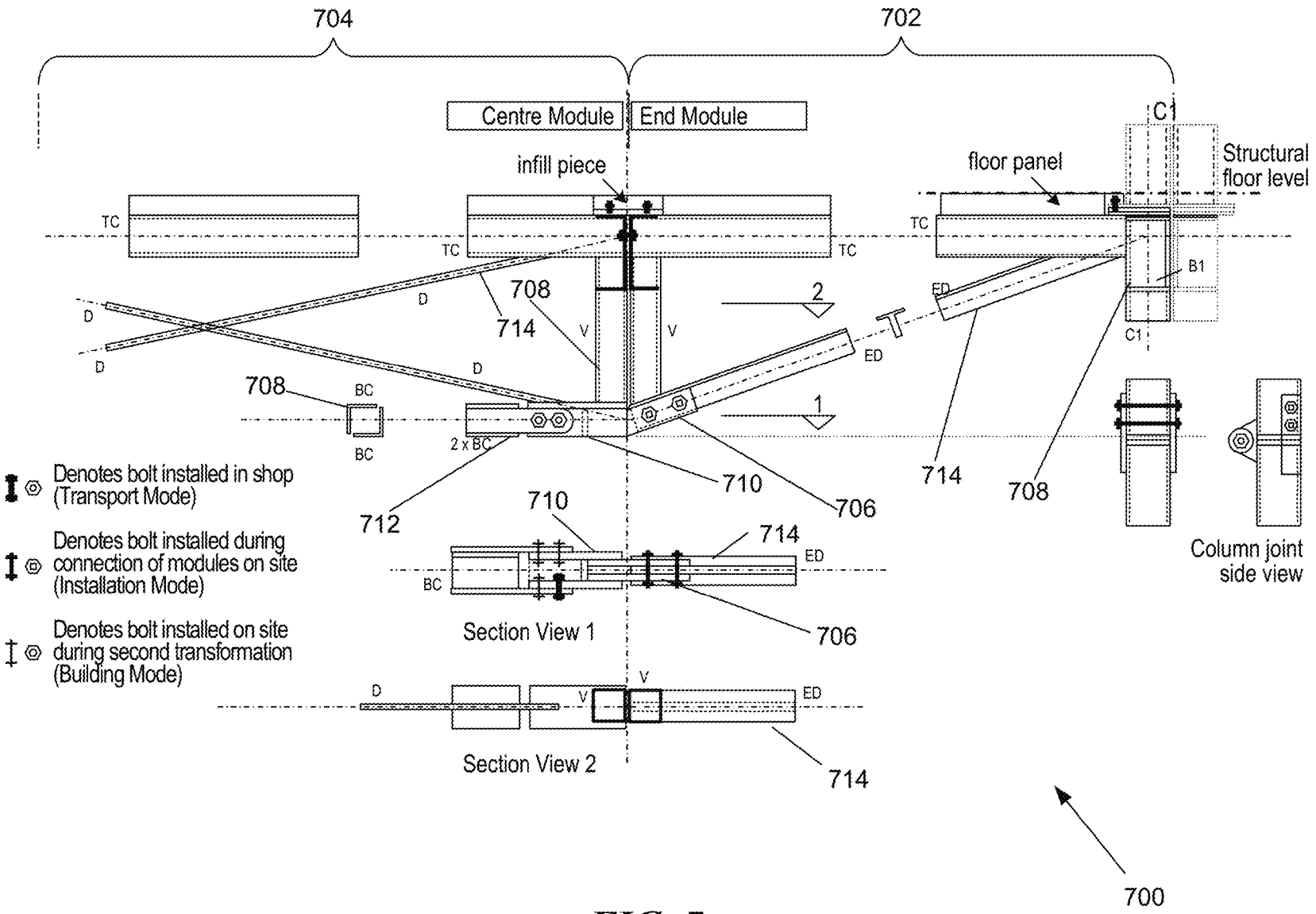
FIG. 7 is a schematic view of column-to-truss transforming elements of a varied transforming volumetric module.

FIG. 7 is a schematic view of column-to-truss transforming elements of a varied transforming volumetric module. FIG. 7 has a resemblance to FIG. 3. The varied transforming volumetric modules of FIG. 7 make use of fewer vertical column to truss transformations than the embodiment of FIG. 3. However, the embodiment of FIG. 7 implements a more restrictive module installation order to compensate for the reduced number of transforming columns.

The schematic view depicts two modules 702 and 704 in various states and configurations. The two modules 702, 704 are bolted together via at least a pronged flange 706 that is a part of the middle module 704. The modules 702, 704 include a number of beams and support joints 708, 710, 712, and 714.

Module 702 is an end truss module. The end module 702 differs from the corresponding end module 302 in that the diagonal truss 714 need not transform. The end module 702 is installed after the middle module 704 and leans against the middle module 704 during installation. During installation the fixed diagonal truss 714 of the end module 702 slides into the pronged flange 706 and is bolted in place. The pronged flange 706 is arranged at an angle matching the diagonal truss 714 and the T-bar element of the diagonal truss 714 slides between the prongs of the flange 706. The pronged flange 706 enables structural connection between the truss elements of each adjacent module.

The transforming columns of end module 702 are the exterior columns and are designed similar to those depicted in FIG. 5. Thus, the column transformation of the end module 702 occurs only during transport and is completed before installation.

As with the embodiments described in FIG. 3, the overall building is constructed in completed floors—that is, prior to adding modules for subsequent floors, the modules in a current floor are each transitioned first.

Module 704 is a middle truss module. The middle module 704 is similar to the corresponding middle module 304. Vertical support column 708 is a fixed column within the truss zone, and support column 712 rotates about a bolt on connective joint 710. The primary variation between middle module 304 and middle module 704 is the bolts used to secure the beams 712 during transformation folding into horizontal trusses and the presence of the pronged flange 706. The beams 712 are configured to together form a single, horizontal beam via two L-bar elements, acting as the bottom member of the truss once fully rotated and bolted in place.

Figure 8:
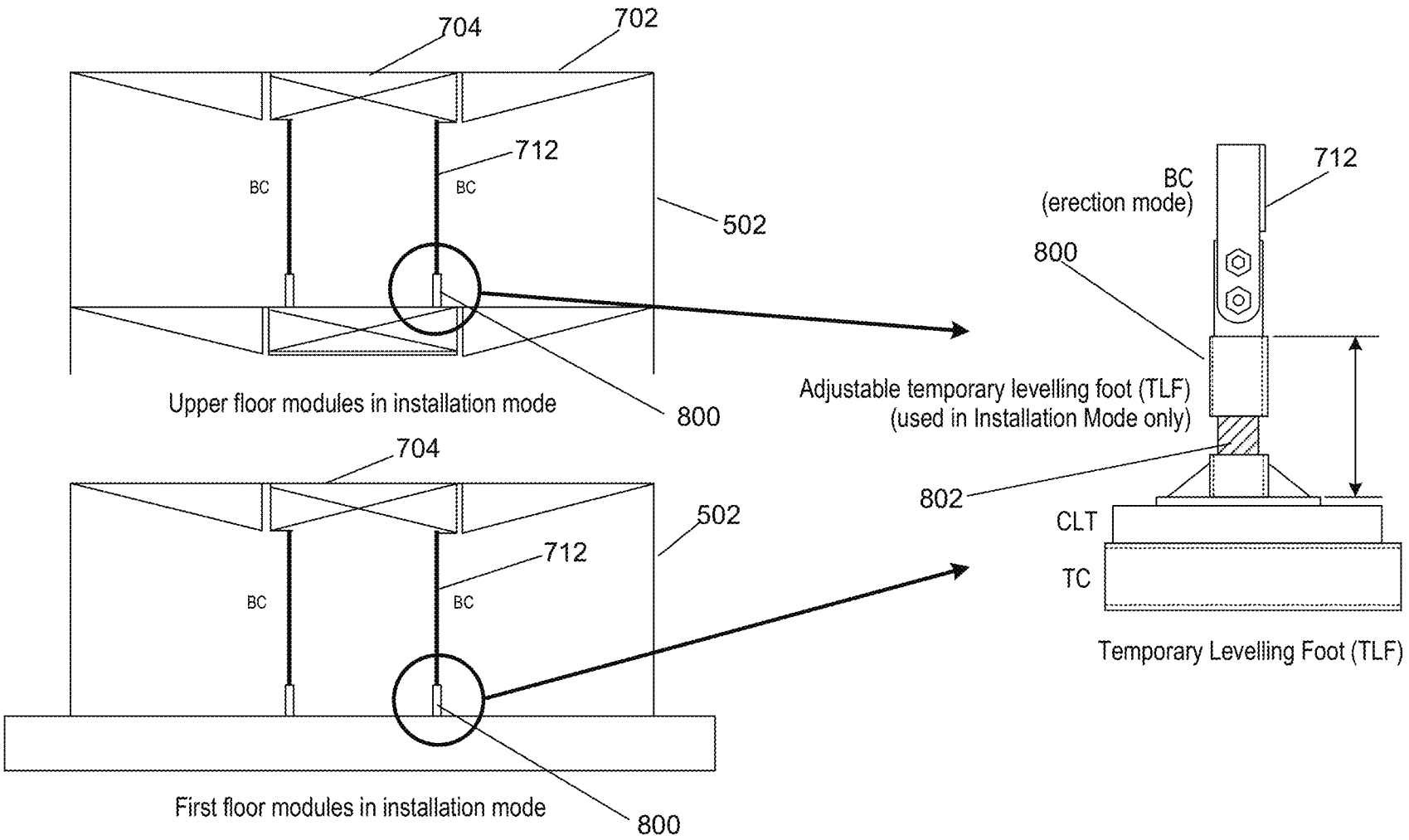
FIG. 8 is a schematic diagram of implementation of an adjustable temporary leveling foot.

FIG. 8 is a schematic diagram of implementation of an adjustable temporary leveling foot (TLF) 800. Once removed from transport, a TLF 800 is attached to each middle module 704, and specifically the end of each transforming support column 712. The TLF 800 provides a stable temporary base for support columns 714 during installation and transformation, and further enables the middle module 704 to have an adjustable height that matches a height of end module 702's vertical columns 502. The transforming support columns 714 are of a fixed length in non-telescoping embodiments, the transforming support columns 714 must have length relative to the width of the middle module 704. The width of the middle module 704 is not necessarily a dimension to which the overall height of the end module 704 and overall height of the floor should be limited to; in most building designs, these dimensions are not equal. Thus, the TLF 800, via extension length 802 enables changes in the height of the middle module 704 while the transforming support columns 714 are in a vertical configuration. A given building construction site includes a set of four TLFs 800 per installation/transformation crew on site.

Figure 9A:
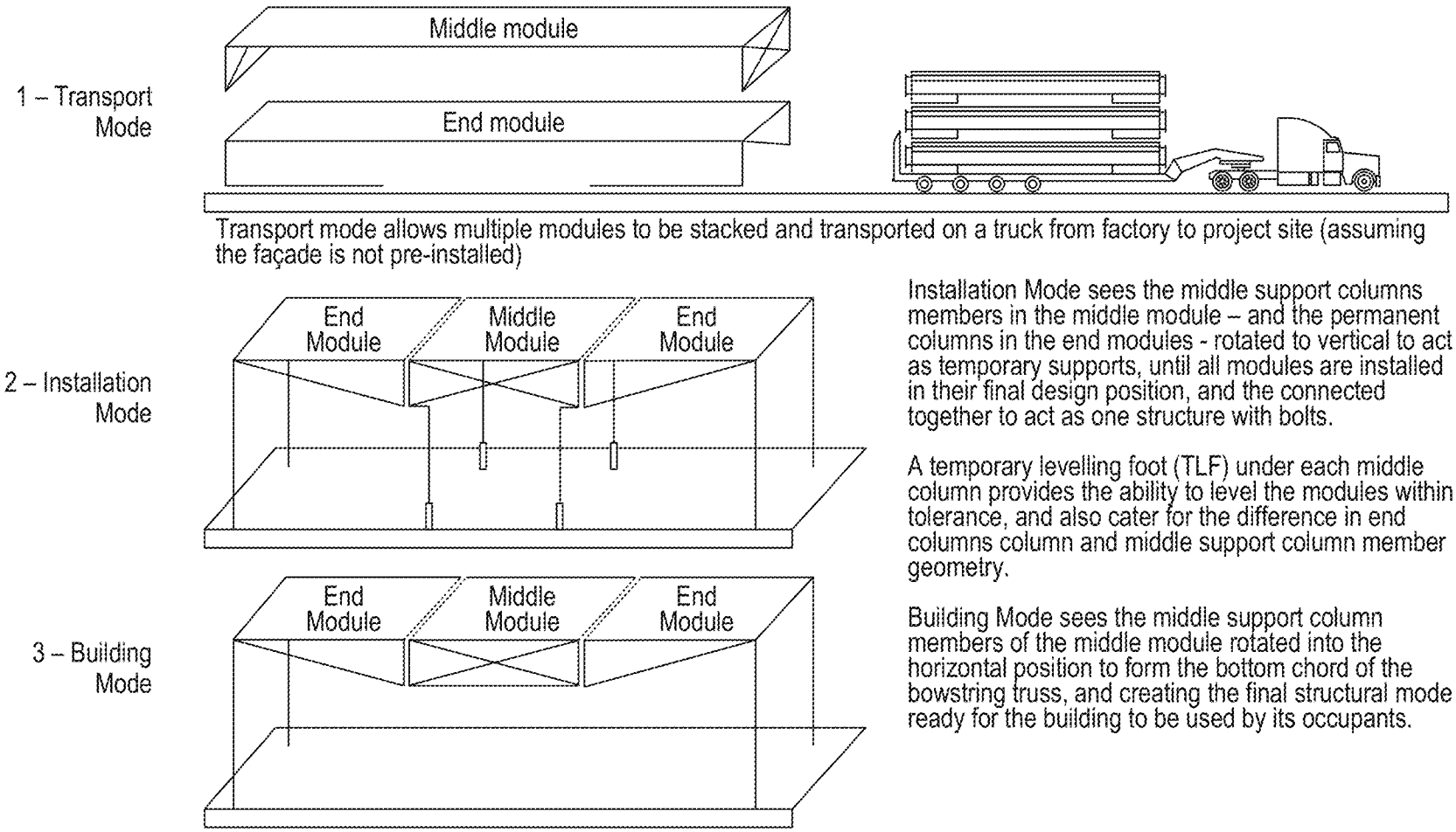

FIGS. 9A-H are step-by-step illustrations of a transition method of a second a varied transforming volumetric module. FIG. 9A is an overview figure, and FIGS. 9B through 9H illustrate individual stages during installation. The process of installing the varied embodiments of the transforming volumetric module dispenses with the directional transformations in favor of a module installation order. During transport mode, end truss modules are positioned below middle truss modules. Middle truss modules are installed before end truss modules, and thus, arranging the middle modules on top of a transport stack is efficient as those modules are installed first.

The middle modules are installed with vertical trusses, and the end modules are leaned up against the middle module. Once the modules are all in place, the vertical columns of the middle module are transformed into horizontal truss configurations. The depicted overview makes use of a 2-to-1 ratio of end modules to middle modules; however, some configurations make use of additional middle modules for greater column-free spans.

Figure 9B:
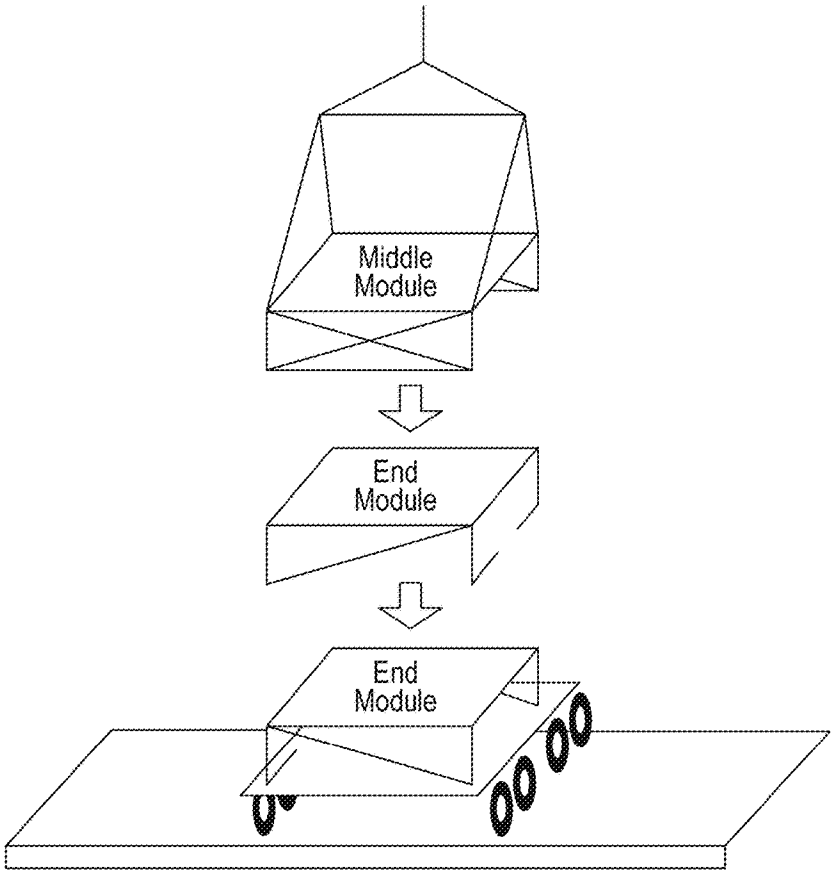
Figure 9B:
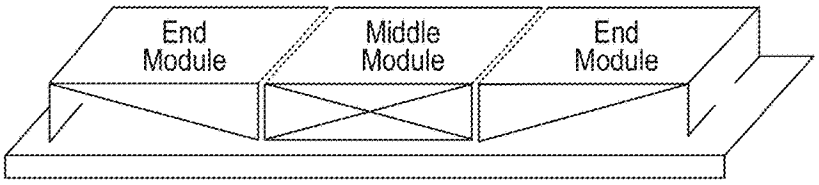

With respect to FIG. 9B, in step 902, modules are test-fit after initial construction. Presuming that the test-fit or quality control stage is passed successfully, the modules are stacked in a transportation mode (e.g., with vertical trussed folded to horizontal) in step 904. The stack positions middle modules on top of the stack. In some embodiments, where a given building configuration makes use of multiple middle modules, truck loading changes. Specifically, some trucks load all or more middle modules whereas other trucks include the end modules.

Figure 9C:
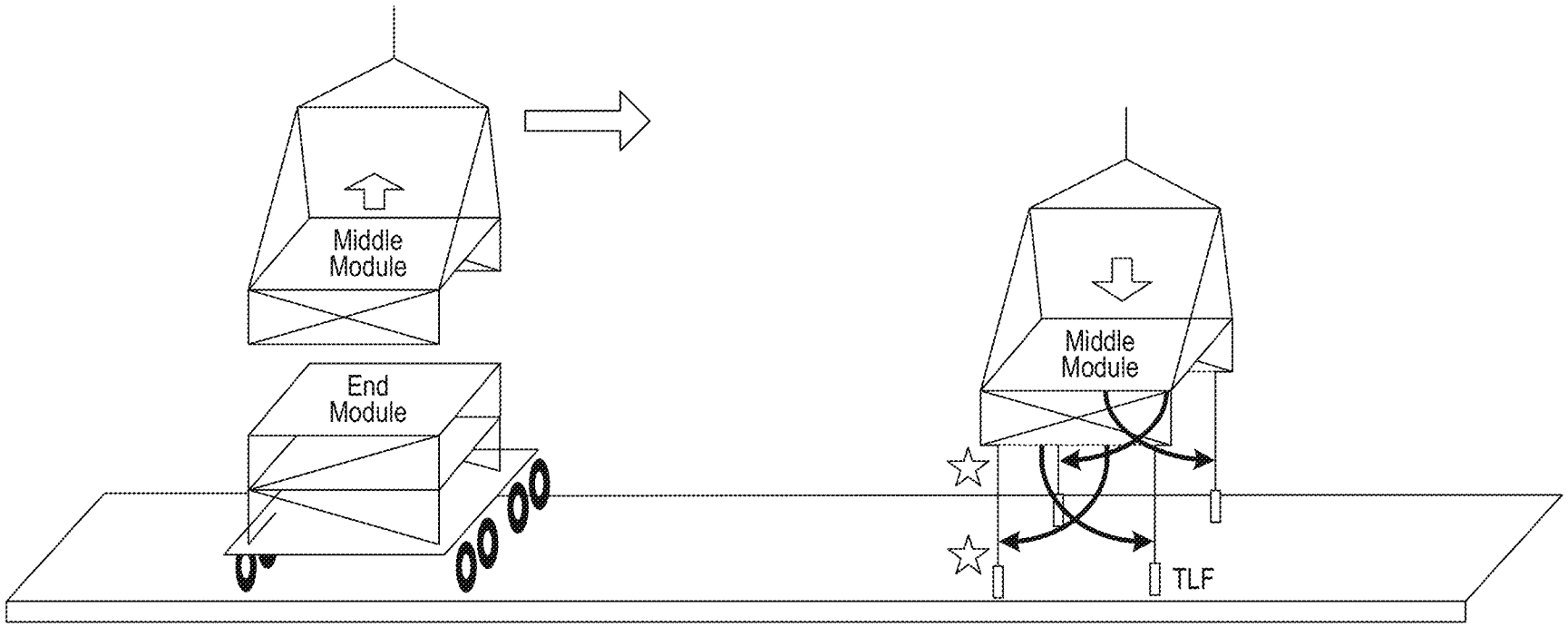

With respect to FIG. 9C, at the building site, in step 906, modules are removed from the truck by crane. In step 908, the middle module is positioned first, and the four columns are transformed from transport/building mode to vertical column mode. Adjustable temporary leveling feet at the base of each column correct inconsistencies in the ground or installation plane as well as manage building floor height. Bolts are placed to lock various vertical column joints in place. The lifting gear then releases.

Figure 9D:
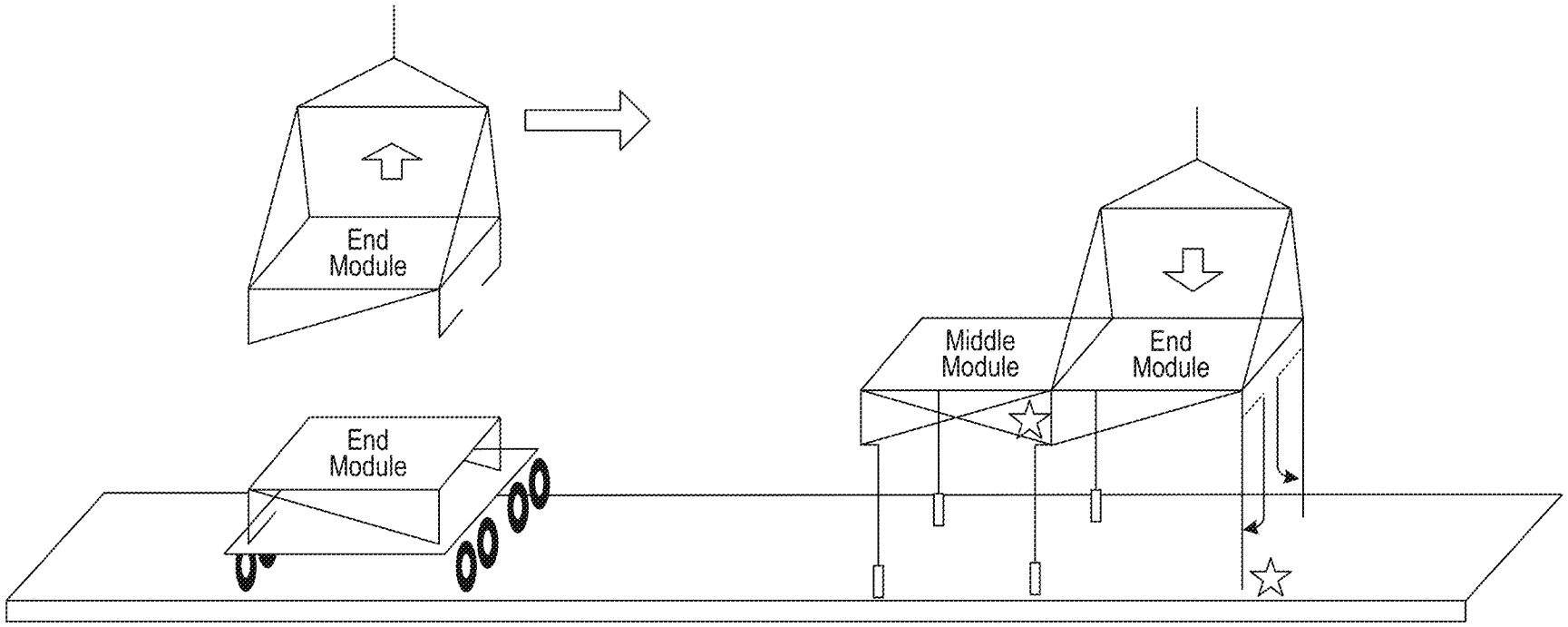
Figure 9E:
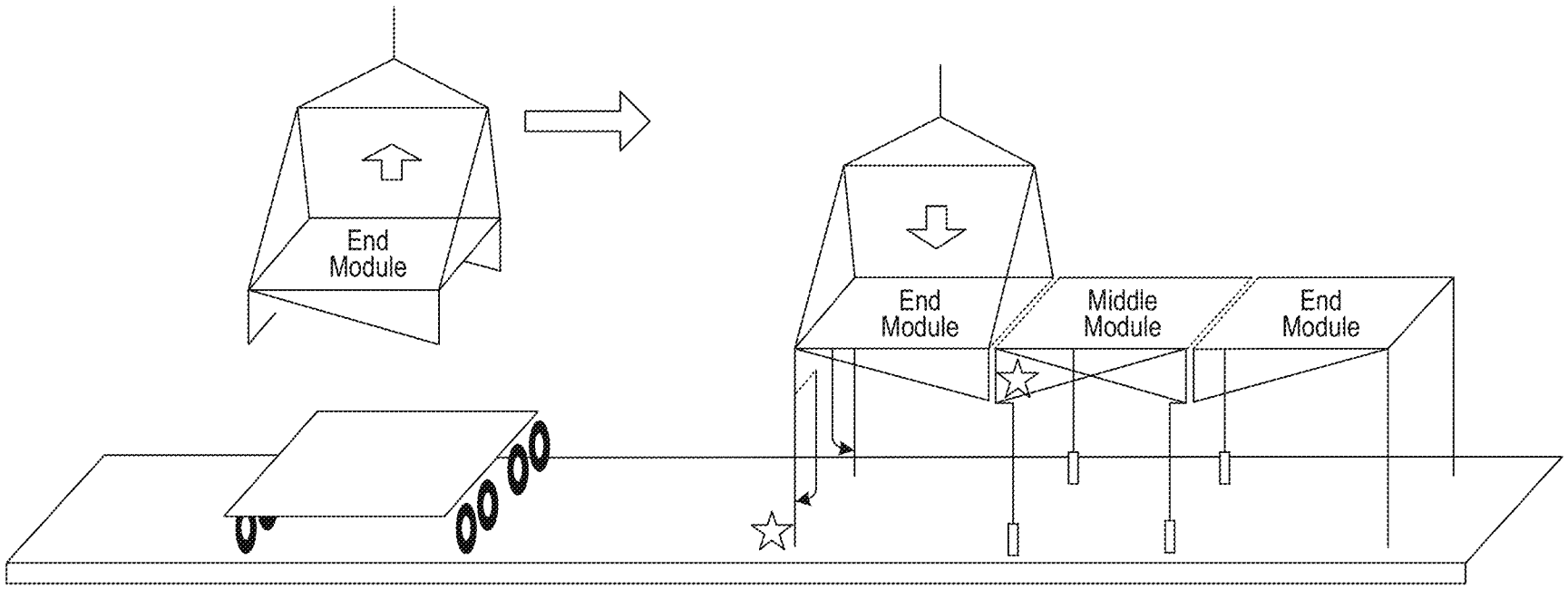

With respect to FIG. 9D, and FIG. 9E, in step 910, the end modules are positioned by crane. In step 912, the end modules each transition the exterior columns from transport mode to permanent vertical column mode. The interior side of the end module leans up against a previously positioned middle module. Bolts are placed on the exterior vertical columns and between the end modules and the middle modules.

With respect to FIG. 9F, in steps 914 and 916, the transforming vertical columns of the middle module are transformed against into the truss configuration. The order of the transformation of vertical columns is non-specific. The transformed columns brace against existing permanent diagonal columns of the end modules. During the transformation, the TLFs are removed. Because the feet are not permanent, one need not manufacture a set of four for each middle module, but rather make use of a set of four based on work crew size or based on the number of unsupported middle modules (e.g., modules not bolted to end modules) that are installed at once. Steps 914 and 916 are performed again for the backside of each middle module.

Figure 9G:
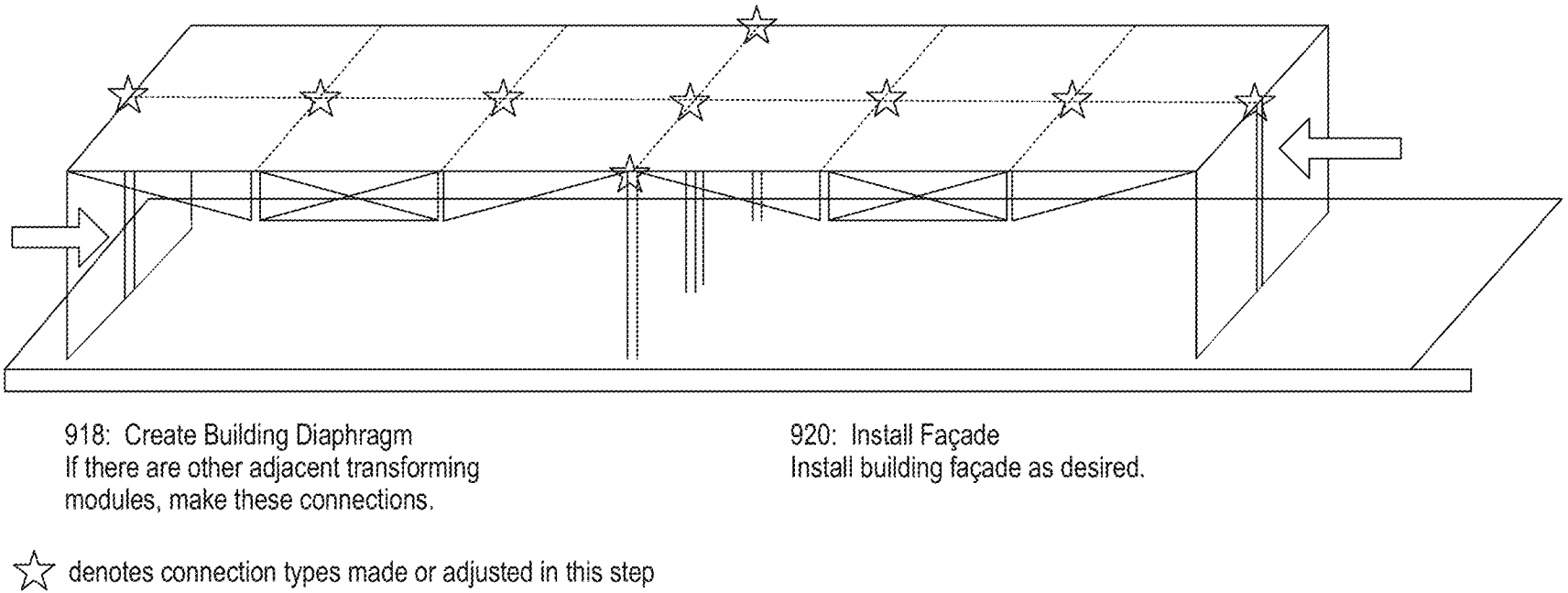
Figure 9H:
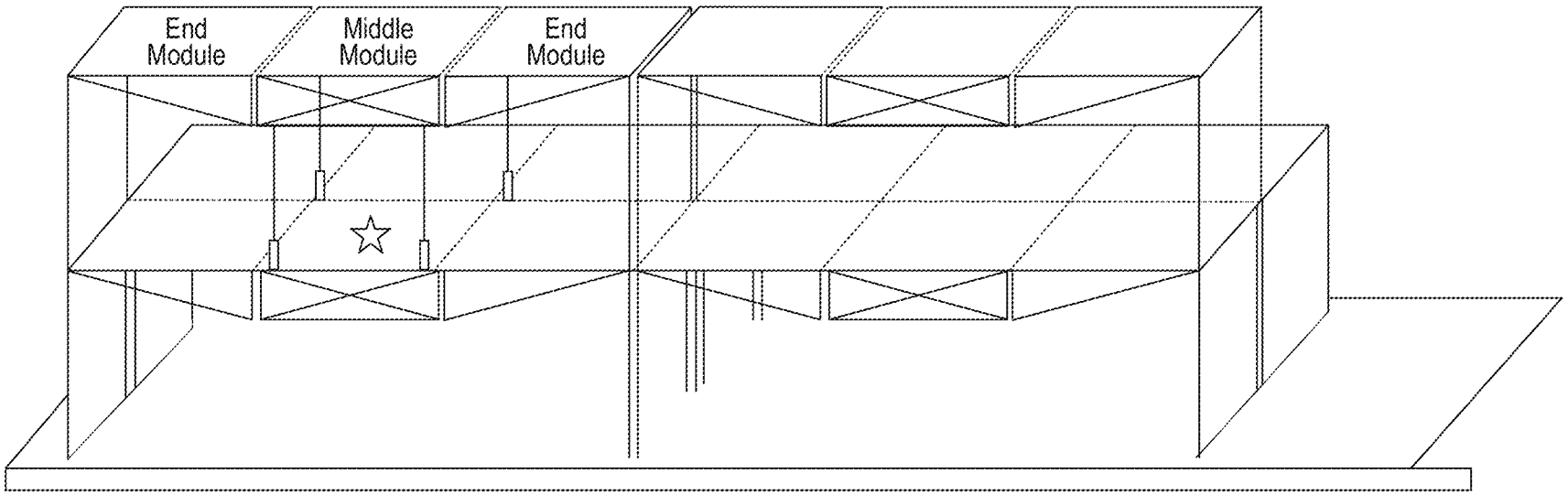

With respect to FIG. 9G, in step 918, sets of transformed modules are bolted together. The adjacent modules are bolted together in order to begin forming the overall shape of the desired building. In step 920, end modules that are truly at the edge or exterior of the building includes external façade installation. As pictured, four end modules are present in the center of the building whereas four other end modules are present at the true edges of the building. With respect to FIG. 9H, the above stages are repeated for subsequent, higher floors.

Figure 10:
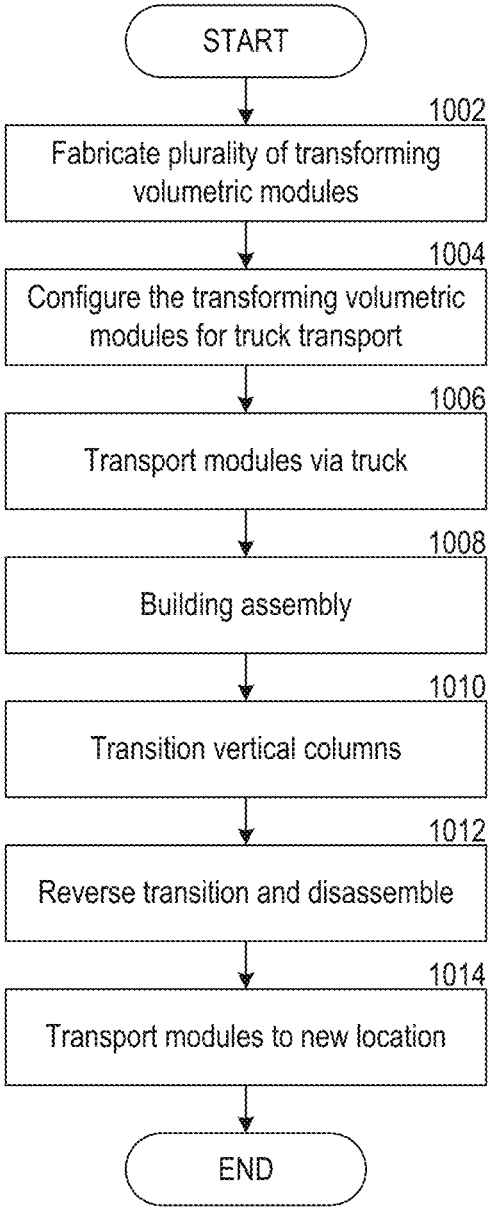
FIG. 10 is a flowchart illustrating transport configurations of the transforming volumetric modules.

FIG. 10 is a flowchart illustrating transport configurations of the transforming volumetric modules. In step 1002, a facility fabricates a plurality of transforming volumetric modules. Each of the transforming volumetric module includes a habitation zone and a truss zone positioned above the habitation zone, the plurality of transforming volumetric modules including vertical support columns positioned on external edges that are configured to fold at a column joint and reduce overall height of the volumetric module. The column joint is positioned where the habitation zone meets the truss zone.

In step 1004, the plurality of transforming volumetric modules for transport on trucks are configured, wherein the vertical support columns are folded, thereby reducing the height of each of the plurality of transforming volumetric modules and enabling multiple to stack on each truck. In step 1006, trucks transport the plurality of transforming volumetric modules to a construction site. In step 1008, workers assemble the building from the volumetric modules by arranging the plurality of transforming volumetric modules into a floorplan configuration with vertical support columns in a vertical arrangement.

In step 1010, workers transition the vertical support columns from the vertical arrangement to a truss arrangement via a telescoping action that reduces individual column length while transitioning in a specified order. In step 1012, workers reverse the transition process (of step 1010) and the assembly process (of step 1008). Step 1012 potentially occurs after a period of building use and is instigated by the building location no longer being ideal for building operation. In step 1014, workers return the modules to transport configuration and transport the volumetric modules to another location to reassemble the building.

Building Design

Figure 11:
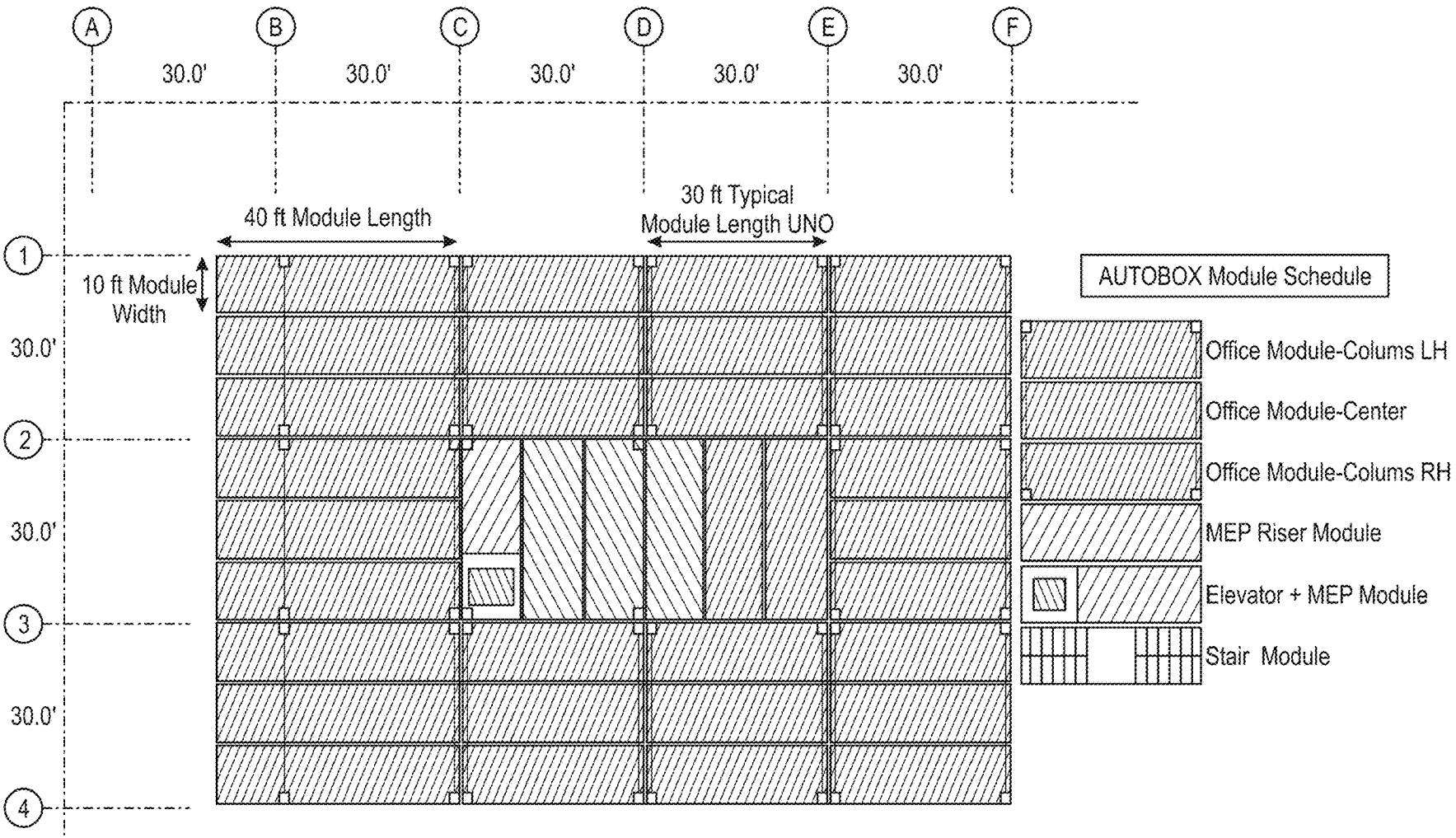
FIG. 11 is an illustration of a building design implementing the transforming volumetric modules.
Figure 12:
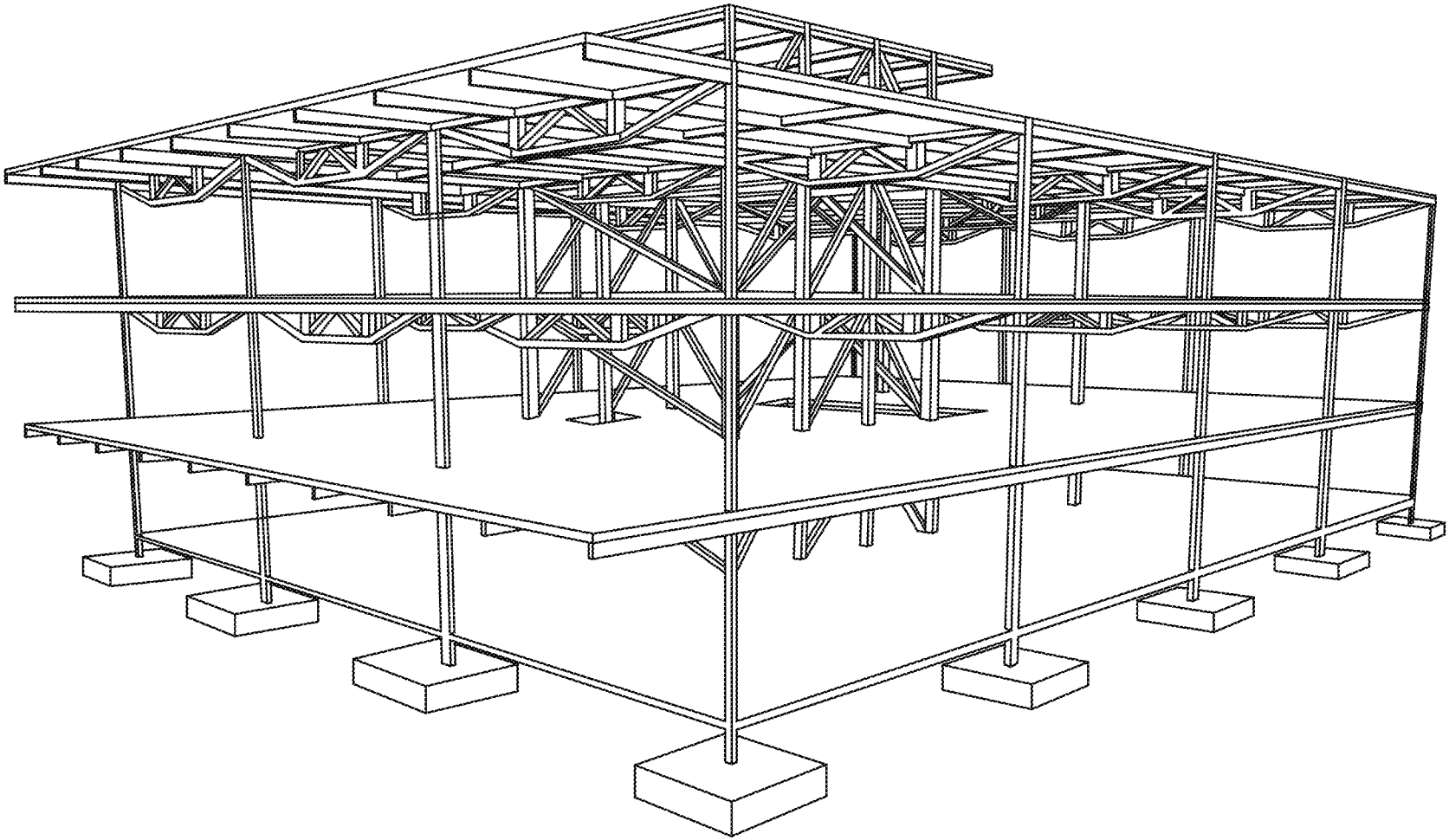
FIG. 12 is a 3D rendering of the building design implementing the transforming volumetric modules of FIG. 11.

FIG. 11 is an illustration of a building designed implementing the transforming volumetric modules. FIG. 12 is a 3D rendering of the building design implementing the transforming volumetric modules of FIG. 8. FIG. 8 depicts a single floor of the multi-floor building as rendered in FIG. 12.

Looking at the single floor of FIG. 11, on an outer perimeter of the building a repeating pattern of three volumetric modules generate a set (9) of 30 by 30-foot open spaces. Structural columns are present only at each corner of the 30 by 30-foot spaces. On one edge, a 10-foot balcony overhangs. In the building center, a number of bathroom modules (that include additional plumbing hookups) are positioned with an elevator module (including gaps that adjoin with modules positioned both above and below, vertically.

Thus, there are six different types of modules depicted in the single floor design. The six include: a standard edge truss module, a standard interior truss module, a balconied edge truss module, a balconied middle truss module, a bathroom module, and an elevator module. Each module has a place in the floor and an orientation. Across all floors, different modules are used to achieve different effects desired within the building.

When designing the building, a planner/designer makes use of a design program. The design program references a database of an available library of modules. In some embodiments, a designer selects from the library of modules to design and assemble a desired building. In some embodiments, a designer first free-designs a building, and then a program identifies which modules to use (from the library) to construct the designed building. Designers are generally unhindered by module components when planning open space requirements of the building.

The program makes use of heuristics and 3D packing algorithms to align library modules' elements with designed space in the building. In some embodiments, a machine learning algorithm is employed to place modules from the library to match building requirements. The machine learning algorithm is trained similarly to a computer vision algorithm, but whereas a computer vision algorithm identifies particular objects (e.g., a dog, a cat, a hamburger, or a skateboard), the algorithm is trained to match spatial requirements with available volumetric modules from the library.

Different modules are implemented based on desired open space requirements of the building. A design program renders the relevant modules in a configuration that accommodates the desired building. Not all modules need to be specifically rectangular (or truck bed-shaped). Curved elements smaller than a module are fabricated as a single module, whereas curved elements larger than a single module arrange modules to approximate an integral of the space and the curve is finished by on-site workers after the volumetric modules are placed.

Atriums, or vertical open spaces, are met by the library of modules via the lack of modules on a given floor or the use of extremely long end module vertical supports (e.g., length relative to the overall module length). The top of the atrium is assembled from the top portion of transforming volumetric modules. Once the support columns have been transformed into trusses, the bottom floor portion may be removed by workers.

Figure 13:
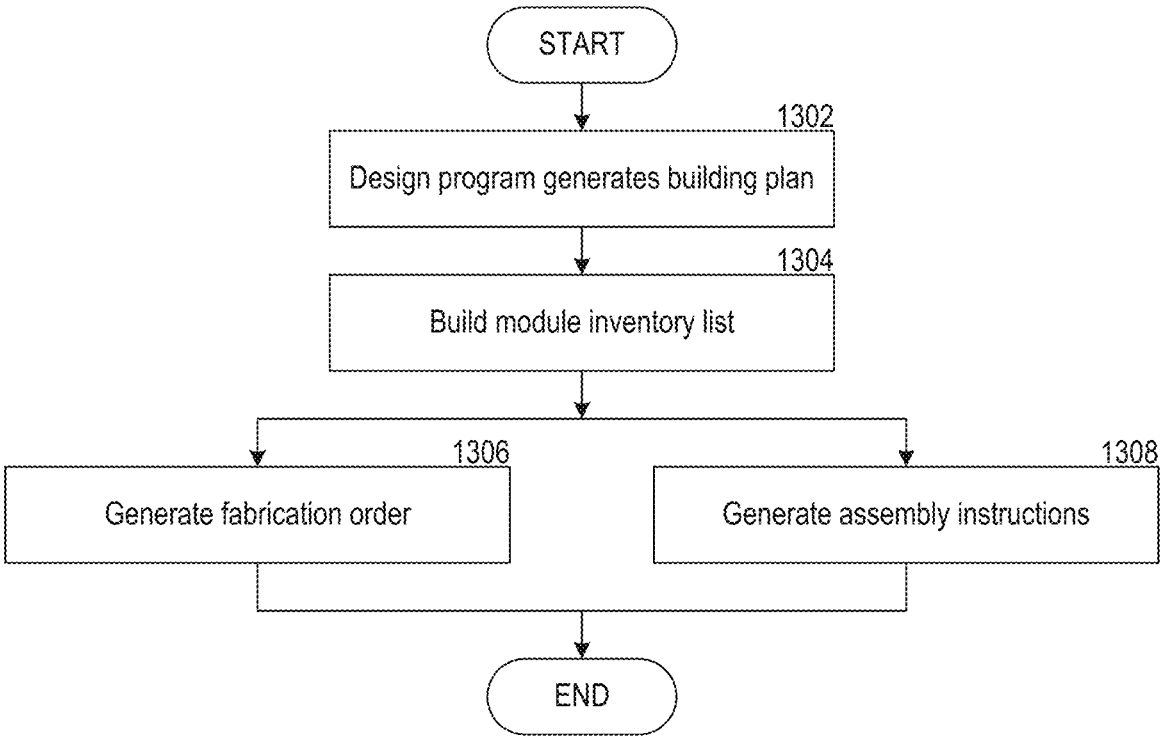
FIG. 13 is a flowchart illustrating a building design method implementing the transforming volumetric modules.

FIG. 13 is a flowchart illustrating a building design method implementing the transforming volumetric modules. In step 1302, a design program generates a plan for a building. In some embodiments, the building plan is generated from linking together elements from a library of modules. In some embodiments, the building plan is free-designed from computer-aided-design (CAD) elements. From the CAD rendering, the design program automatically associates all portions of the building with a set of modules from the library.

In step 1304, once modules are assigned to building space, the design program generates an inventory list of modules. In step 1306, from the inventory list, a fabrication order can be generated for the building. Secondarily, in step 1308, a set of build instructions associates fabricated volumetric modules with particular points in the building and an orientation for those volumetric modules. The build instructions are a step-by-step guide to the order in which the modules are assembled as a building and where each module goes. The step-by-step guide includes instructing the workers on an order of transformation of the support columns such that structural integrity is maintained across the installed volumetric modules.

Computing Platform

Figure 14:
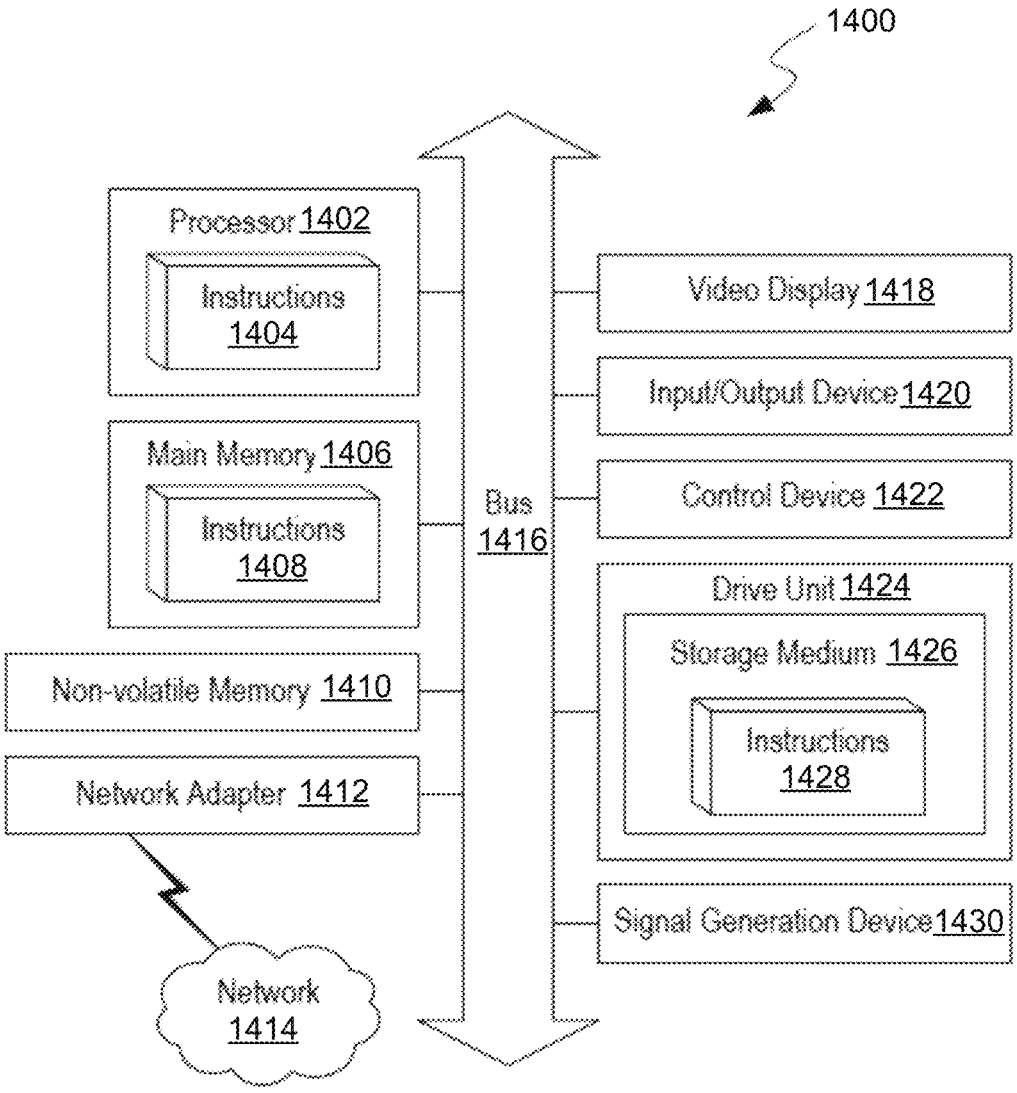
FIG. 14 is a block diagram of an exemplary computing system.

FIG. 14 is a block diagram illustrating an example computer system 1400, in accordance with one or more embodiments. In some embodiments, components of the example computer system 1400 are used to implement the software platforms described herein. At least some operations described herein can be implemented on the computer system 1400.

The computer system 1400 can include one or more central processing units ("processors") 1402, main memory 1406, non-volatile memory 1410, network adapters 1412 (e.g., network interface), video displays 1418, input/output devices 1420, control devices 1422 (e.g., keyboard and pointing devices), drive units 1424 including a storage medium 1426, and a signal generation device 1420, which are communicatively connected to a bus 1416. The bus 1416 is illustrated as an abstraction that represents one or more physical buses and/or point-to-point connections that are connected by appropriate bridges, adapters, or controllers. The bus 1416, therefore, can include a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus (also referred to as "Firewire").

The computer system 1400 can share a similar computer processor architecture as that of a desktop computer, tablet computer, personal digital assistant (PDA), mobile phone, game console, music player, wearable electronic device (e.g., a watch or fitness tracker), network-connected ("smart") device (e.g., a television or home assistant device), virtual/augmented reality systems (e.g., a head-mounted display), or another electronic device capable of executing a set of instructions (sequential or otherwise) that specify action(s) to be taken by the computer system 1400.

While the main memory 1406, non-volatile memory 1410, and storage medium 1426 (also called a "machine-readable medium") are shown to be a single medium, the term "machine-readable medium" and "storage medium" should be taken to include a single medium or multiple media (e.g., a centralized/distributed database and/or associated caches and servers) that store one or more sets of instructions 1428. The term "machine-readable medium" and "storage medium" shall also be taken to include any medium that is capable of storing, encoding, or carrying a set of instructions for execution by the computer system 1400. In some embodiments, the non-volatile memory 1410 or the storage medium 1426 is a non-transitory, computer-readable storage medium storing computer instructions, which can be executed by the one or more processors 1402 to perform functions of the embodiments disclosed herein.

In general, the routines executed to implement the embodiments of the disclosure can be implemented as part of an operating system or a specific application, component, program, object, module, or sequence of instructions (collectively referred to as "computer programs"). The computer programs typically include one or more instructions (e.g., instructions 1404, 1408, 1428) set at various times in various memory and storage devices in a computer device. When read and executed by the one or more processors 1402, the instruction(s) cause the computer system 1400 to perform operations to execute elements involving the various aspects of the disclosure.

Moreover, while embodiments have been described in the context of fully functioning computer devices, those skilled in the art will appreciate that the various embodiments are capable of being distributed as a program product in a variety of forms. The disclosure applies regardless of the particular type of machine or computer-readable media used to actually effect the distribution.

Further examples of machine-readable storage media, machine-readable media, or computer-readable media include recordable-type media such as volatile and non-volatile memory devices 1410, floppy and other removable disks, hard disk drives, optical discs (e.g., Compact Disc Read-Only Memory (CD-ROMS), Digital Versatile Discs (DVDs)), and transmission-type media such as digital and analog communication links.

The network adapter 1412 enables the computer system 1400 to mediate data in a network 1414 with an entity that is external to the computer system 1400 through any communication protocol supported by the computer system 1400 and the external entity. The network adapter 1412 can include a network adapter card, a wireless network interface card, a router, an access point, a wireless router, a switch, a multilayer switch, a protocol converter, a gateway, a bridge, a bridge router, a hub, a digital media receiver, and/or a repeater.

The network adapter 1412 can include a firewall that governs and/or manages permission to access proxy data in a computer network and tracks varying levels of trust between different machines and/or applications. The firewall can be any number of modules having any combination of hardware and/or software components able to enforce a predetermined set of access rights between a particular set of machines and applications, machines and machines, and/or applications and applications (e.g., to regulate the flow of traffic and resource sharing between these entities). The firewall can additionally manage and/or have access to an access control list that details permissions including the access and operation rights of an object by an individual, a machine, and/or an application, and the circumstances under which the permission rights stand.

The techniques introduced here can be implemented by programmable circuitry (e.g., one or more microprocessors), software and/or firmware, special-purpose hardwired (i.e., non-programmable) circuitry, or a combination of such forms. Special-purpose circuitry can be in the form of one or more application-specific integrated circuits (ASICs), programmable logic devices (PLDs), field-programmable gate arrays (FPGAs), etc. A portion of the methods described herein can be performed using the example ML system 1500 illustrated and described in more detail with reference to FIG. 15.

Machine Learning System

Figure 15:
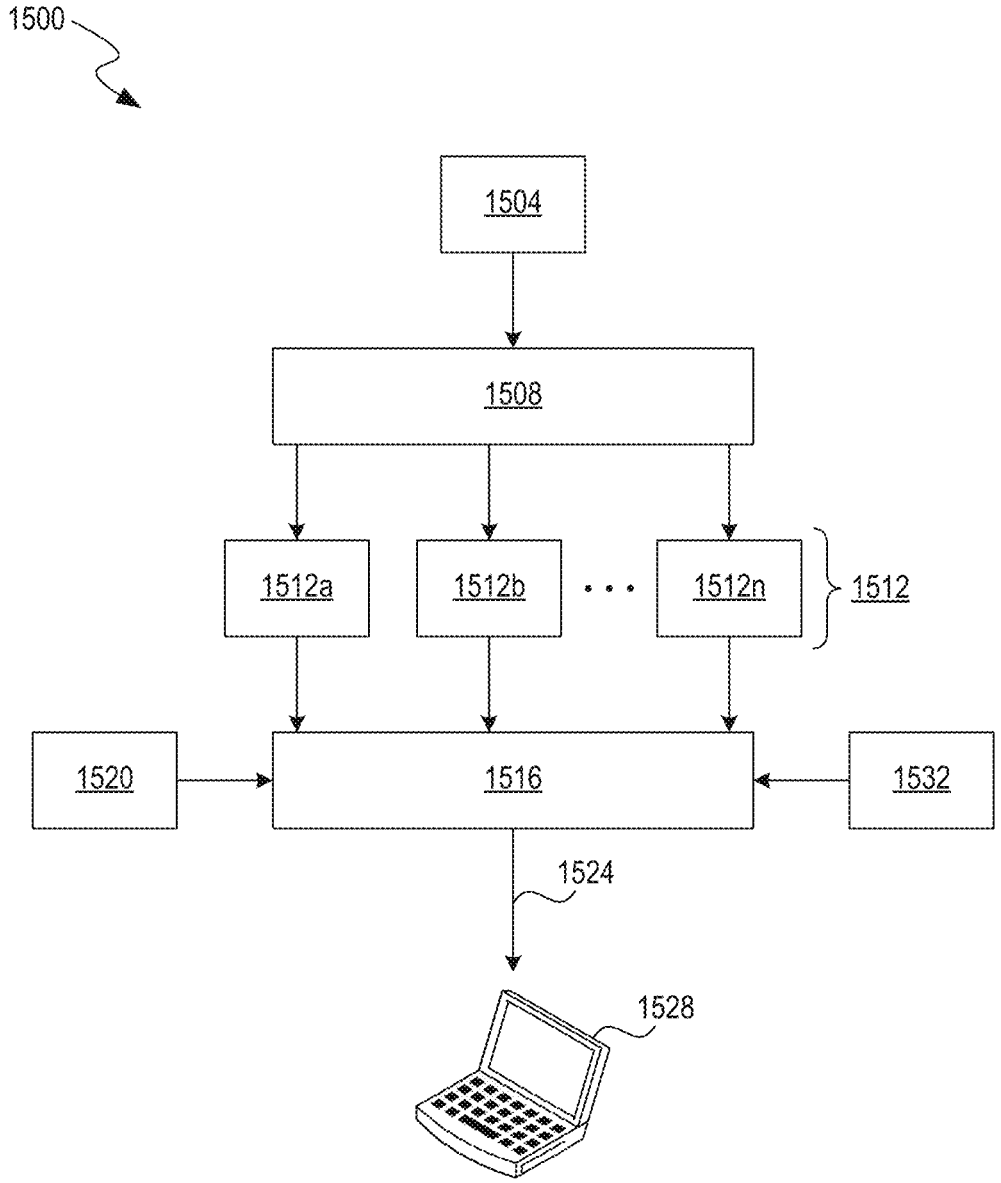
FIG. 15 is a block diagram illustrating an example machine learning (ML) system, in accordance with one or more embodiments.

FIG. 15 is a block diagram illustrating an example ML system 1500, in accordance with one or more embodiments. The ML system 1500 is implemented using components of the example computer system 1400 illustrated and described in more detail with reference to FIG. 14. Likewise, embodiments of the ML system 1500 can include different and/or additional components or be connected in different ways. The ML system 1500 is sometimes referred to as an ML module.

The ML system 1500 includes a feature extraction module 1508 implemented using components of the example computer system 1400 illustrated and described in more detail with reference to FIG. 14. In some embodiments, the feature extraction module 1508 extracts a feature vector 1512 from input data 1504. For example, the input data 1504 can include one or more images, sets of text, audio files, or video files. The feature vector 1512 includes features 1512*a*, 1512*b*, . . . 1512*n*. The feature extraction module 1508 reduces the redundancy in the input data 1504, e.g., repetitive data values, to transform the input data 1504 into the reduced set of features 1512, e.g., features 1512*a*, 1512*b*, . . . 1512*n*. The feature vector 1512 contains the relevant information from the input data 1504, such that events or data value thresholds of interest can be identified by the ML model 1516 by using this reduced representation. In some example embodiments, dimensionality reduction techniques, such as principal component analysis (PCA) or autoencoders are used by the feature extraction module 1508.

In alternate embodiments, the ML model 1516 performs deep learning (also known as deep structured learning or hierarchical learning) directly on the input data 1504 to learn data representations, as opposed to using task-specific algorithms. In deep learning, no explicit feature extraction is performed; the features 1512 are implicitly extracted by the ML system 1500. For example, the ML model 1516 can use a cascade of multiple layers of nonlinear processing units for implicit feature extraction and transformation. Each successive layer uses the output from the previous layer as input. The ML model 1516 can learn in supervised (e.g., classification) and/or unsupervised (e.g., pattern analysis) modes. The ML model 1516 can learn multiple levels of representations that correspond to different levels of abstraction, wherein the different levels form a hierarchy of concepts. In this manner, the ML model 1516 can be configured to differentiate features of interest from background features.

In alternative example embodiments, the ML model 1516, e.g., in the form of a CNN, generates the output 1524 without the need for feature extraction, directly from the input data 1504. The output 1524 is provided to the computer device 1528. The computer device 1528 is a server, computer, tablet, smartphone, smart speaker, etc., implemented using components of the example computer system 1400 illustrated and described in more detail with reference to FIG. 14. In some embodiments, the steps performed by the ML system 1500 are stored in memory on the computer device 1528 for execution. In other embodiments, the output 1524 is displayed on high-definition monitors.

A CNN is a type of feed-forward artificial neural network in which the connectivity pattern between its neurons is inspired by the organization of a visual cortex. Individual cortical neurons respond to stimuli in a restricted region of space known as the receptive field. The receptive fields of different neurons partially overlap such that they tile the visual field. The response of an individual neuron to stimuli within its receptive field can be approximated mathematically by a convolution operation. CNNs are based on biological processes and are variations of multilayer perceptrons designed to use minimal amounts of preprocessing.

The ML model 1516 can be a CNN that includes both convolutional layers and max pooling layers. The architecture of the ML model 1516 can be "fully convolutional," which means that variable sized sensor data vectors can be fed into it. For all convolutional layers, the ML model 1516 can specify a kernel size, a stride of the convolution, and an amount of zero padding applied to the input of that layer. For the pooling layers, the ML model 1516 can specify the kernel size and stride of the pooling.

In some embodiments, the ML system 1500 trains the ML model 1516, based on the training data 1520, to correlate the feature vector 1512 to expected outputs in the training data 1520. As part of the training of the ML model 1516, the ML system 1500 forms a training set of features and training labels by identifying a positive training set of features that have been determined to have a desired property in question and a negative training set of features that lack the property in question. The ML system 1500 applies ML techniques to train the ML model 1516, that when applied to the feature vector 1512, outputs indications of whether the feature vector 1512 has an associated desired property or properties.

The ML system 1500 can use supervised ML to train the ML model 1516, with features from the training sets serving as the inputs. In some embodiments, different ML techniques, such as support vector machine (SVM), regression, naïve Bayes, random forests, neural networks, etc., are used. In some example embodiments, a validation set 1532 is formed of additional features, other than those in the training data 1520, which have already been determined to have or to lack the property in question. The ML system 1500 applies the trained ML model 1516 to the features of the validation set 1532 to quantify the accuracy of the ML model 1516. In some embodiments, the ML system 1500 iteratively retrains the ML model 1516 until the occurrence of a stopping condition, such as the accuracy measurement indicating that the ML model 1516 is sufficiently accurate or a number of training rounds having taken place.

The description and drawings herein are illustrative and are not to be construed as limiting. Numerous specific details are described to provide a thorough understanding of the disclosure. However, in certain instances, well-known details are not described in order to avoid obscuring the description. Further, various modifications can be made without deviating from the scope of the embodiments.

Consequently, alternative language and synonyms can be used for any one or more of the terms discussed herein, and no special significance is to be placed upon whether or not a term is elaborated or discussed herein. Synonyms for certain terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification.

It is to be understood that the embodiments and variations shown and described herein are merely illustrative of the principles of this invention and that various modifications can be implemented by those skilled in the art.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described but can be practiced with modification and alteration within the spirit and scope of the appended claims. Accordingly, the specification and drawings are to be regarded in an illustrative sense rather than a restrictive sense.

The invention claimed is:

1. A method of construction using prefabricated volumetric modules that generates open space without interrupting vertical columns comprising:

fabricating a plurality of transforming volumetric modules, each transforming volumetric module including a habitation zone and a truss zone positioned above the habitation zone, the plurality of transforming volumetric modules including vertical support columns positioned on external edges that are configured to fold at a column joint and become trusses in the truss zone, wherein the column joint is positioned where the habitation zone meets the truss zone;

configuring the plurality of transforming volumetric modules for transport on trucks, wherein the vertical support columns are folded horizontally in the habitation zone thereby reducing a height of each of the plurality of transforming volumetric modules and enabling multiple to stack on each truck; and stacking multiple folded transforming volumetric modules on a single truck bed.

2. The method of claim 1, wherein the plurality of transforming volumetric modules are fabricated as either of edge modules or interior modules, and said stacking wherein the interior modules are placed on top of the edge modules on the single truck bed.

3. The method of claim 1, further comprising:

transporting the plurality of transforming volumetric modules to a construction site;

at the construction site, configuring the vertical support columns to a vertical arrangement; and with the vertical support columns in the vertical arrangement, arranging the plurality of transforming volumetric modules into a floorplan configuration.

4. The method of claim 1, wherein the plurality of transforming volumetric modules are constructed of any of:

steel;

concrete;

timber; or mass timber composite.

5. The method of claim 1, wherein said configuring is performable with a winch and hand tools.

6. The method of claim 1, further comprising:

transporting the plurality of transforming volumetric modules to a construction site;

arranging the plurality of transforming volumetric modules into a floorplan configuration with vertical support columns in a vertical arrangement in a specified order, wherein an interior module is placed into the floorplan configuration first and one or more edge modules are subsequently placed into the floorplan configuration leaning against the interior module;

affixing the plurality of transforming volumetric modules together to one another; and transitioning the vertical support columns of the interior module from the vertical arrangement to a truss arrangement; and installing mechanical, electrical, and plumbing ("MEP") elements in the truss zone.

7. The method of claim 6, further comprising:

transitioning the vertical support columns from the truss arrangement to the vertical arrangement;

removing the plurality of transforming volumetric modules from the floorplan configuration in a reverse of the specified order;

transporting the plurality of transforming volumetric modules to a new building location; and reconstructing the plurality of transforming volumetric modules into the floorplan configuration and transitioning the vertical support columns at the new building location.

8. A method comprising:

unloading a plurality of transforming volumetric modules from stacks on transport trucks, each transforming volumetric module including a habitation zone and a truss zone positioned above the habitation zone, the plurality of transforming volumetric modules including vertical support columns positioned on external edges that are configured to fold at a column joint and become trusses in the truss zone, wherein the column joint is positioned where the habitation zone meets the truss zone, and wherein while positioned on the transport trucks the vertical support columns are in a folded configuration; and setting the plurality of transforming volumetric modules upright via unfolding the vertical support columns to upright in the habitation zone thereby increasing a height of each of the plurality of transforming volumetric modules.

9. The method of claim 8, wherein the plurality of transforming volumetric modules are fabricated as either of edge modules or interior modules, and said stacking wherein the interior modules are placed on top of the edge modules on a truck bed.

10. The method of claim 8, further comprising:

transporting the plurality of transforming volumetric modules to a construction site;

at the construction site, configuring the vertical support columns to a vertical arrangement; and with the vertical support columns in the vertical arrangement, arranging the plurality of transforming volumetric modules into a floorplan configuration.

11. The method of claim 8, wherein the plurality of transforming volumetric modules are constructed of any of:

steel;

concrete;

timber; or mass timber composite.

12. The method of claim 8, wherein said setting is performable with a winch and hand tools.

* * * * *